US007251445B2

(12) United States Patent
Hirai

(10) Patent No.: US 7,251,445 B2
(45) Date of Patent: Jul. 31, 2007

(54) IMAGE FORMATION DEVICE AND IMAGE FORMING METHOD USING SAME

(75) Inventor: Masashi Hirai, Katano (JP)

(73) Assignee: Sharp Kabushiki Kaisha, Osaka (JP)

( * ) Notice: Subject to any disclaimer, the term of this patent is extended or adjusted under 35 U.S.C. 154(b) by 112 days.

(21) Appl. No.: 11/087,910

(22) Filed: Mar. 22, 2005

(65) Prior Publication Data

US 2005/0214038 A1 Sep. 29, 2005

(30) Foreign Application Priority Data

Mar. 22, 2004 (JP) ..... 2004-083668

(51) Int. Cl.
*G03G 15/01* (2006.01)

(52) U.S. Cl. ..... 399/302; 399/299; 399/178

(58) Field of Classification Search ..... 399/178, 399/179, 298, 200, 300, 302; 347/115, 116
See application file for complete search history.

(56) References Cited

U.S. PATENT DOCUMENTS 5,347,353 A * 9/1994 Fletcher ..... 399/299
6,021,287 A * 2/2000 Tanaka ..... 399/299 X
6,389,260 B1 5/2002 Kataoka et al.
6,970,673 B2 * 11/2005 Amarakoon ..... 399/298

FOREIGN PATENT DOCUMENTS

JP 05-273830 10/1993
JP 2001-154445 6/2001
JP 2001-209232 8/2001

* cited by examiner

*Primary Examiner*—Sandra L. Brase
(74) *Attorney, Agent, or Firm*—George W. Neuner; David G. Conlin; Edwards Angell Palmer & Dodge LLP

(57) ABSTRACT

An image forming apparatus is provided with a latent image carrier for holding an electrostatic latent image, and an intermediate transfer member for temporally holding an image formed by visualizing the electrostatic latent image formed on the latent image carrier. The image forming apparatus performs image formation by superimposing a plurality of images on the intermediate transfer member so as to form a superimposing image, and transferring the superimposing image on a recording medium. The intermediate transfer member has a latent image holding property for holding the electrostatic latent image. An image formed by visualizing an electrostatic latent image formed on the intermediate transfer member is superimposed with the electrostatic latent image formed on the latent image carrier.

18 Claims, 6 Drawing Sheets

IMAGE FORMATION DEVICE AND IMAGE FORMING METHOD USING SAME

This Nonprovisional application claims priority under 35 U.S.C. § 119(a) on patent application Ser. No. 83668/2004 filed in Japan on Mar. 22, 2004, the entire contents of which are hereby incorporated by reference.

FIELD OF THE INVENTION

The present invention relates to an image forming device such as printers, facsimiles, copying machines and the like. More particularly, the present invention relates to an intermediate-transfer-type image forming device and an image forming method using the same. The intermediate-transfer-type image forming device temporally transfers, to an intermediate transfer member, an image formed by visualizing an electrostatic latent image formed on a latent image carrier and then forms an image by transferring the image held by an intermediate transfer member to a recording medium.

BACKGROUND OF THE INVENTION

Conventionally, an electrophotograph-type color-image forming method has been often used as a method for forming a color-image on a recording paper. The electrophotograph-type color-image forming method develops an electrostatic latent image formed on a latent image carrier by a developing device and the image formed on the latent image carrier by developer is finally transferred to paper fed.

A generally used color-image forming device employs the above method is an image forming device which (a) includes a plurality of latent image carriers in order to prevent deceleration of image forming speed, (b) uses different color materials as developer for the respective latent image carriers and (c) forms a color-image by superimposing images formed on the respective latent image carriers.

However, in recent years, many studies have been made to develop intermediate-transfer-type image forming devices in order to deal with varieties of sheets. The intermediate-transfer-type image forming devices do not transfer an image to a recording sheet directly from the latent image carrier, but ultimately transfers, to the recording sheet, a color image formed by superimposing images on the intermediate transfer member to which the images are temporary transferred. (For example, refer to the Japanese Laid-Open Patent Publication 209232/2001 (Tokukai 2001-209232 published on Aug. 3, 2001); corresponding U.S. Pat. No. 6,389,260 and the Japanese Laid-Open Patent Publication 154445/2001 (Tokukai 2001-154445 published on Jun. 8, 2001))

As an image forming device that employs an intermediate transfer system like this, a so-called tandem image forming device is generally used. Though there may be some difference in layout, the tandem image forming device, as illustrated in FIG. 8, is provided, along an intermediate transfer belt 304, with (i) an intermediate transfer belt 304 tensioned by tension rollers 302 and 303 between the rollers 302 and 303, which is used as a intermediate transfer, and (ii) plural image forming stations Pa, Pb, Pc, and Pd, which form images by respective different Color materials.

However, in spite of its high image forming speed, the conventional tandem image forming device has a problem in that a size of the device becomes large due to a large number of component parts.

Specifically in an intermediate-transfer type image forming device as in FIG. 8, an image formed at each image forming stations Pa, Pb, Pc, and Pd goes through the following processes: a) a primary transfer process where the image is temporarily transferred to an intermediate transfer belt 304 from photosensitive drums 222*a*, 222*b*, 222*c*, and 222*d* that are latent image carriers and b) a second transfer process where the image after the primary transfer process is transferred to recording paper P from the intermediate transfer belt 304. Thus, the image forming device including four latent image carriers as in FIG. 8 has five transfer processes because the primary transfer processes whose number of times is equivalent to the number of photosensitive drums 222*a*, 222*b*, 222*c*, and 222*d* and the second transfer process (a transfer process for transferring the images together at once) are carried out. Further, the respective image forming stations Pa, Pb, Pc, and Pd should be arranged such that the photosensitive drums 222*a*, 222*b*, 222*c*, and 222*d* and the intermediate transfer belt 304 are respectively provided with five cleaning devices (cleaning devices 226*a*, 226*b*, 226*c*, 226*d* and 221 in FIG. 8) for removing residual developer, which is not transferred but left over (remained). Accordingly, this causes a problem in that (a) the device tends to be large in size and (b) production cost increases due to a large number of component parts.

SUMMARY OF THE INVENTION

An object of the present invention is to downsize (miniaturize) an image forming device by reducing number of component parts in consideration of the above conventional problem.

In order to attain the object, an image forming apparatus of the present invention including (i) a latent image carrier for holding an electrostatic latent image, and (ii) an intermediate transfer member for temporally holding an image formed by visualizing the electrostatic latent image formed on the latent image carrier, the image forming apparatus performing image formation by (1) transferring, to the intermediate transfer member, the image formed by visualizing the latent image formed on the latent image carrier, so as to superimpose the image on an image held on the intermediate transfer member in order to prepare an superimposition image on the intermediate transfer member, and then (2) transferring the superimposition image onto a recording medium, is arranged such that the intermediate transfer member has a latent image holding property for holding an electrostatic latent image; and an image formed on the intermediate transfer member by visualizing an electrostatic latent image formed on the intermediate transfer member is superimposed with the image formed by visualizing the electrostatic latent image formed on the latent image carrier.

Moreover, in order to attain the object, an image forming apparatus of the present invention including (i) a plurality of latent image carriers for holding electrostatic latent images respectively, and (ii) an intermediate transfer member for temporally holding the latent images formed on the latent image carriers, the image forming apparatus performing image formation by (1) forming the electrostatic latent images on the latent image carriers, (2) visualizing the electrostatic latent images so as to form images in different colors, (3) transferring, one by one onto the intermediate transfer member, the images thus formed in different colors, so as to form an image as a result of the transfer of the respective images thus formed in different colors and (4) transferring the image from the intermediate transfer member onto a recording medium, is arranged such that the intermediate transfer member has a latent image holding property for holding an electrostatic latent image; and an image formed on the intermediate transfer member by visualizing an electrostatic latent image formed on the intermediate transfer member is superimposed with the images formed by visualizing the electrostatic latent images respectively formed on the latent image carriers.

Furthermore, in order to attain the object, a method of the present invention for forming an image by using an image forming apparatus including a latent image carrier for holding an electrostatic latent image, and an intermediate transfer member having a latent image holding property for holding an electrostatic latent image, includes forming the electrostatic latent image on the intermediate transfer member and visualizing the electrostatic latent image so as to form an image on the intermediate transfer member; forming the electrostatic latent image on the latent image carrier and visualizing the electrostatic latent image so as to form an image on the latent image carrier; performing primary transfer for transferring, onto the intermediate transfer member, the image formed on the latent image carrier, so as to form a primary transfer image, and superimposing, onto the primary transfer image, the image formed on the intermediate transfer member, so as to form a superimposed image on the intermediate transfer member; and performing secondary transfer for transferring the superimposed image on a recording medium, so as to form an image.

With these arrangements, the intermediate transfer member can function as a latent image carrier because the intermediate transfer member has the latent image holding property for holding the electrostatic latent image. Because of this, these arrangements allows reduction of a number of the latent image carriers. Moreover, with these arrangements, a number of transfer (a number of transfer processes) from the latent image carrier to the intermediate transfer member can be reduced. Thus, it is possible to reduce numbers of necessary components such as cleaning sections, transferring sections and other components which are necessary as many as the number of transfer, that is, as many as the latent image carriers. As a result, the image forming apparatus can be downsized accordingly.

For a fuller understanding of the nature and advantages of the invention, reference should be made to the ensuing detailed description taken in conjunction with the accompanying drawings.

DESCRIPTION OF THE EMBODIMENTS

First Embodiment

Referring to FIGS. 1 through 5 and 8, an exemplary embodiment of the present invention is explained below. In the following explanation, a tandem (multi-drum-type) digital color copying machine is discussed as an example of an image forming device according to the present embodiment of the present invention. The image forming device adopts an intermediate transfer system, by which a toner image formed on a photosensitive member temporally is indirectly transferred to recording paper (a recording sheet, a recording medium). In the image forming device, plural image forming stations, which form images using different Color materials respectively, are arranged along an intermediate transfer member. However, the present invention is not limited to this copying machine. Furthermore, component parts that have the same function as those in conventional art are labeled in the same manner.

Figure 1:
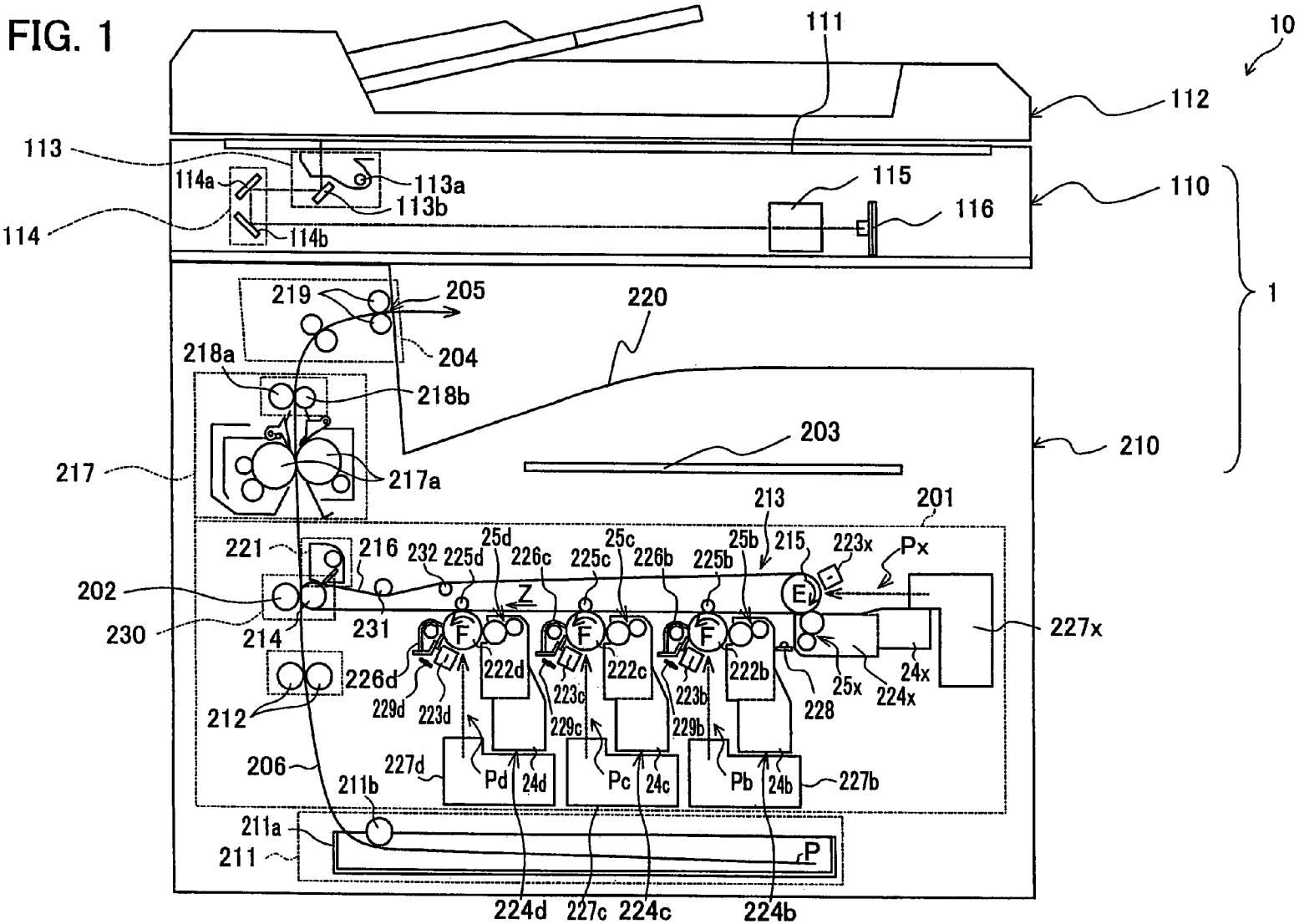
FIG. 1 is a sectional view schematically illustrating a structure of an image forming device according to an exemplary embodiment of the present invention.

FIG. 1 is a sectional view schematically illustrating a structure of a digital color copying machine 10 (an image forming device) according to the present embodiment of the present invention.

As illustrated in FIG. 1, the digital color copying machine 10 according to the present embodiment of the present invention includes a copying machine main body 1, which includes an image reader section 110 and an image forming section 210 inside, and a RADF (Reversing Automatic Document Feeder) 112 that feeds a document, which is a target to be copied, into the image reader section 110 in the copying machine main body 1.

On an upper surface of the copying machine main body 1, a document platform 111 and an operation panel (not illustrated) are provided. On the upper surface of the document platform 111, the RADF 112 is so provided that it can be opened and closed with respect to the document platform 111 and can be fixed at a predetermined position with respect to the surface of the document platform 111.

The RADF 112 first feeds a document sheet so that, at a predetermined position on the document platform 111, one side of the document sheet faces the image reader section 110 and then, after reading the side of the document sheet finishes, turns over the document sheet and feeds the document sheet so that, at the predetermined position on the document platform 111, the other side of the document sheet faces the image reader section 110. After the RADF 112 finishes reading both sides of the document sheet, the RADF 112 ejects the document sheet and then carries out feeding and reversing-sides operation for a next document. The above feeding and reversing-sides operation for a document sheet is controlled by a controller section 203 in the image forming section 210 in accordance with the operation of a whole copying machine.

The image reader section 110 is arranged below the document platform 111 in order to read an image from the document sheet which the RADF 112 has fed onto the document platform 111. The image reader section 110 includes (i) a document scanner, which have a first scanning unit 113 and a second scanning unit 114 which move back and forth parallel with an under surface of the document platform 111, (ii) an optical lens 115 and (iii) a CCD line sensor 116 that is a photoelectric transfer element.

The first scanning unit 113 includes an exposure lump 113*a* and a first mirror 113*b*. The exposure lump 113*a* exposes that surface (image surface) of the document on which an image is, and the first mirror 113*b* deflects a reflected light image from the document toward a predetermined direction. The exposure lump 113*a* and the first mirror 113*b* are arranged to move back and forth in parallel with the under surface of the document platform 111 at a predetermined scanning speed. Here, the distance between the first scanning unit 113 and the document platform 111 are kept constant. The second scanning unit 114 includes a second mirror 114*a* and a third mirror 114*b*. The second mirror 114*a* and the third mirror 114*b* further deflect, toward a predetermined direction, the reflected light image of the document, the reflected light image deflected by the first mirror 113*b* of the first scanning unit 113. The second scanning unit 114 is arranged to move back and forth with a constant speed relationship with the first scanning unit 113 as well as in parallel with the first scanning unit 113.

An optical lens 115 shrinks the reflected light image of the document, the reflected light image deflected by the third mirror 114*b* of the second scanning unit 114. The shrunk light image is formed on a predetermined position of the CCD line sensor 116 by the optical lens 115. A dashed dotted line of the image reader section 110 in FIG. 1 is a reflection route of the reflected light image.

The CCD line sensor 116 outputs the formed light image as an electrical signal by sequentially carrying out photoelectric transfer. The CCD line sensor 116 according to the present embodiment is a 3-line color CCD capable of reading a black-and-white image or a color image and outputting line data whose color is separated into each color component; R(Red), G(Green) and B(Blue). Document image information that is transformed into an electrical signal by this CCD line sensor 116 is used for image formation explained later, after the document image information is, further, sent forward to an image processing section that is not illustrated in FIGS. and a predetermined image data processing is executed.

Next, a structure of each section in the image forming section 210 is explained.

The image forming section 210, as illustrated in FIG. 1, includes a paper supply mechanism 211 (a recording medium supplying section), a transfer device 201 (a transfer section), a fixing device 217 (a fixing section), a controller section 203, an output section 204 (a recording medium outputting section) and a recording medium transport route 206. The paper supply mechanism 211 stores recording paper P as a recording medium on which a toner image (an image) is formed by a toner (developer (color material)). The transfer device 201 (transfer section) forms the above toner image and transfers the image to the paper P. The fixing device 217 fixes the toner image transferred to the recording paper P by fusing. The controller section 203 controls operation of the whole copying machine. The output section 204 outputs the paper P, on which an image is fixed, outside from the copying machine main body 1. The recording medium transport route 206 connects the paper supply mechanism 211, the transfer device 201, the fixing device 217 and the output section 204.

The paper supply mechanism 211 is provided in a lower portion of the image forming section 210. The paper supply mechanism 211 includes a paper feeding cassette 211*a* and a paper feed roller 211*b*. The paper feeding cassette 211*a* stores recording paper P loaded inside. The paper feed roller 211*b* is arranged to separate the loaded recording paper P (a recording medium) stored in the paper feeding cassette 211*a* into each sheet and to supply to a secondary transfer section 230 in the transfer device 201.

The transfer device 201 includes an intermediate transfer belt mechanism 213, image forming stations Px, Pb, Pc, and Pd, resist rollers 212 and a secondary transfer roller 202. The secondary transfer section 230 includes the secondary transfer roller 202 and a driven roller 214 in the intermediate transfer belt mechanism 213.

At a downstream of paper transport direction (herein, denoted simply as "downstream" or "downstream side") in the paper supply mechanism 211, the resist rollers 212, the secondary transfer section 230, the fixing device 217, and the output section 204 are provided in this order along the recording medium transport route 206, toward the upper left in the FIG. 1.

The supplied paper P, after the paper is separated sheet by sheet at the paper supply mechanism 211, is fed to the secondary transfer section 230 in a feeding timing controlled by the pair of the resist rollers 212 provided in an upstream of the secondary transfer section 230. After the toner image is transferred to the paper at the secondary transfer section 230, the paper is fed to the fixing device 217. A structure of each part above in the transfer device 201 is later explained.

The fixing device 217 fixes, on the recording paper P that is fed through the recording medium transport route 206, the toner image that is transferred to the recording paper P at the secondary transfer section 230.

The recording medium transport route 206 transports the recording paper P into the fixing device 217 via the resist rollers 212 and the secondary transfer section 230 from the paper supply mechanism 211. In the present embodiment, the paper feeding cassette 211*a* in the paper supply mechanism 211 is provided in the lower portion of the copying machine main body 1. Above the paper supply mechanism 211, the transfer device 201 and the fixing device 217 are provided. Because of this, the recording medium transport route 206 is extended upward in a substantially vertical direction in the copying machine main body 1.

The above fixing device 217 includes a pair of fixing rollers 217*a* and a pair of output rollers 218*a* and 218*b*. The recording paper P on which the toner image has been transferred and formed is outputted after the image is fixed on the recording paper P by the fixing rollers 217*a*. Namely, the paper P, which passes through a nip section between the pair of the fixing rollers 217*a*, passes between the above output rollers 218*a* and 218*b*. Then, the recording paper P is outputted (paper output) onto an output paper tray 220 by output rollers 219; the output paper tray 220 are provided at an outer surface of the copying machine main body 1 and the output rollers 219 are provided in an upstream of a recording medium output vent 205.

The output paper tray 220 is in an uppermost portion of the image forming section 210 (the output paper tray 220 constitutes an upper surface of the image forming section 210) of the copying machine main body 1. The output paper tray 220 is provided at the position below the image reader section 110. The output rollers 219 are arranged to output the recording paper P onto the output paper tray 220 after a toner image is fixed on the recording paper P by the fixing device 217.

The digital color copying machine 10 may have a structure wherein: a re-transport route is included; and the recording paper P is outputted after toner images are formed on both sides of the recording paper P by practicing the following processes to the recording paper P that has been subjected to the fixing roller 217, that is, the recording paper P on one side of which an image has been formed: (a)

feeding the recording paper P again to a transfer device 201 through the re-transport route so that the other side of the recording paper P faces the intermediate transfer belt 216 (later described) in the transfer device 201 by (i) reversing the output rollers 219 and (ii) switching paper feeding direction by using a switching gate (paper handling channel switching means) or the like; and (b) being subjected to the fixing device 217 again.

Next, a structure of each section in the transfer device 201 is explained.

The transfer device 201 is provided above the paper supply mechanism 211. In a middle portion of the image forming section 210 the intermediate transfer belt mechanism 213 is provided.

The intermediate transfer belt mechanism 213 includes the driven roller 214 (a supporting member), a driving roller 215 (a supporting member), tension rollers 231 and 232, primary transfer rollers 225*b*, 225*c*, and 225*d* (primary transfer members, primary transfer means), the intermediate transfer belt 216 (a belt member) and a cleaning device 221 (cleaning means).

The intermediate transfer belt 216 temporarily holds each color toner image (an image) formed at the image forming stations Px, Pb, Pc, and Pd, which are explained later. The intermediate transfer belt 216 is a transfer image carrier (a photoreceptor-cum-intermediate transfer member) that forms a color image by superimposing all of each color toner images. The intermediate transfer belt 216 is tensioned, by the driven roller 214 and the driving roller 215, in substantially horizontal direction between the driven roller 214 and the driving roller 215.

In the present embodiment, the intermediate transfer belt 216 is tensioned horizontally in substantially parallel with the paper feeding cassette 211*a* and the output paper tray 220 in the paper supply mechanism 211. In the present embodiment, the intermediate transfer belt 216, the paper feeding cassette 211*a* and the output paper tray 220 are so provided that they are extended substantially in the same direction (their longitudinal directions are in conformity). This arrangement further prevents the digital color copying machine 10 from being larger in size.

The intermediate transfer belt 216 is friction-driven by the driven roller 214 in the direction shown by the arrow Z in FIG. 1.

The image forming station Px (a first image forming station) is formed in a vicinity of that portion of the intermediate transfer belt 216, which is wound around the driving roller 215, more particularly, that portion from a side of the driving roller 215 to a lower part thereof which is in a downstream with respect to the rotation direction thereof (this portion of the intermediate transfer belt 216 is a portion facing down in FIG. 1 and associated with a lower part of the driving roller 215 in this embodiment). Along one side of the intermediate transfer belt 216 in the downstream with respect to the rotation direction thereof (in FIG. 1, that portion of the intermediate transfer belt 216 which faces down), that is, below the intermediate transfer belt mechanism 213 in this embodiment, a plurality of image forming stations are formed in the vicinity of the intermediate transfer belt 216. The image forming stations form toner images different in color from the image formed by the image forming station Px. In this embodiment, at the lower side of the intermediate transfer belt mechanism 213, the image forming station Pb (a second formation station), the image forming station Pc (a third formation station) and the image forming station Pd (a forth image forming station) are provided in the vicinity of the intermediate transfer belt 216 in this order along the rotation direction of the intermediate transfer belt 216.

These image forming stations Px, Pb, Pc, and Pd are toner image forming sections for respective different colors. In the image forming device of this embodiment, different color images are formed at respective image forming stations: a black (herein, denoted by K) toner image at the image forming station Px; a cyan (herein, denoted by C) toner image at the image forming station Pb; a magenta (herein, denoted by M) toner image at the image forming station Pc; and a yellow (herein, denoted by Y) toner image at the image forming station Pd. However, the present invention is not limited to this. Namely, in this embodiment, the image forming station Px is a black toner image formation section and the image forming stations Pb, Pc, and Pd are chromatic color toner image formation sections.

The image forming stations Pb, Pc, and Pd except the image forming station Px have a substantially identical structure. The image forming stations Pb, Pc, and Pd respectively include (i) photosensitive drums 222*b*, 222*c*, and 222*d* (photoreceptors, latent image carriers) that are rotated in the direction F indicated by an arrow in FIG. 1, (ii) chargers (electric chargers) 223*b*, 223*c*, and 223*d* (charging means), (iii) developing devices 224*b*, 224*c*, and 224*d* (developing means, visualizing (image-visualizing) means, visualizing (image-visualizing) members), (iv) cleaning devices 226*b*, 226*c*, and 226*d* (cleaning means), (v) laser beam writing devices 227*b*, 227*c*, and 227*d* (writing device, writing means) and (vi) discharging lamps 229*b*, 229*c*, and 229*d* (discharging means). Of course, each of the image forming stations Pb, Pc, and Pd may include other structures.

The photosensitive drums 222*b*, 222*c*, and 222*d* are latent image carriers on surfaces of which electrostatic latent images are held by exposure. After the photosensitive drums temporarily hold developed toner images (images) of respective colors respectively, the drums 222*b*, 222*c*, and 222*d* transfer the images to the intermediate transfer belt 216 as a primary transfer process.

Around the photosensitive drums 222*b*, 222*c*, and 222*d* and interposing the intermediate transfer belt 216 between them and the photosensitive drums 222*b*, 222*c*, and 222*d*, not only the primary transfer rollers 225*b*, 225*c*, and 225*d* are provided but also cleaning devices 226*b*, 226*c*, and 226*d*, chargers 223*b*, 223*c*, and 223*d* and developing devices 224*b*, 224*c*, and 224*d* are provided in this order with respect to the rotation direction (in FIG. 1, a direction F) of the photosensitive drums 222*b*, 222*c*, and 222*d* from positions where the photosensitive drums 222*b*, 222*c*, and 222*d* abuts the intermediate transfer belt 216, that is, positions where the primary transfer rollers 225*b*, 225*c*, and 225*d* and the photosensitive drums 222*b*, 222*c*, and 222*d* face each other.

Further, the discharging lamps 229*b*, 229*c*, and 229*d* are respectively provided between the cleaning devices 226*b*, 226*c*, and 226*d* and chargers 223*b*, 223*c*, and 223*d*. Moreover, the lamps 229*b*, 229*c*, and 229*d* are respectively positioned apart from the photosensitive drums 222*b*, 222*c*, and 222*d*. The laser beam writing devices 227*b*, 227*c*, and 227*d* are respectively provided between the discharging lamps 223*b*, 223*c*, and 223*d* and the developing devices 224*b*, 224*c*, and 224*d*. Moreover, the laser beam writing devices 227*b*, 227*c*, and 227*d* are respectively positioned apart from the photosensitive drums 222*b*, 222*c*, and 222*d*.

The chargers 223*b*, 223*c*, and 223*d* are arranged to uniformly charge respective surfaces of the photosensitive drums 222*b*, 222*c*, and 222*d* before exposure to predetermined electric potential. Although in this embodiment, scorotrons are used as the chargers 223*b*, 223*c*, and 223*d*, the present embodiment of the present invention is not limited to this. Charging rollers, charging brushes or the like may be used as the chargers 223*b*, 223*c*, and 223*d*.

The developing devices 224*b*, 224*c*, and 224*d* develop latent images formed on the surfaces of the photosensitive drums 222*b*, 222*c*, and 222*d* to respective toner images.

The developing devices 224*b*, 224*c*, and 224*d* include developer container sections 24*b*, 24*c*, and 24*d* and developing rollers 25*b*, 25*c*, and 25*d*. The developer container sections 24*b*, 24*c*, and 24*d* respectively contain C, M and Y color developers. The developing rollers 25*b*, 25*c*, and 24*d* supply, to the photosensitive drums 222*b*, 222*c*, and 222*d*, toners (developers) respectively contained in the developer container sections 24*b*, 24*c*, and 24*d*. In the developing devices 224*b*, 224*c*, and 224*d*, the developing rollers 25*b*, 25*c*, and 24*d* of the developing devices 224*b*, 224*c*, and 224*d* are respectively arranged to face the surface of the respective photosensitive drums 222*b*, 222*c*, and 222*d*.

The cleaning devices 226*b*, 226*c*, and 226*d* remove (clean off) residual toners on the surfaces of the photosensitive drums 222*b*, 222*c*, and 222*d*.

The laser beam writing devices 227*b*, 227*c*, and 227*d* are writing devices (writing means, exposure means) that expose the photosensitive drums 222*b*, 222*c*, and 222*d* and form electrostatic latent images on the surfaces of the drums 222*b*, 222*c*, and 222*d*.

Pixel signals corresponding to a C color component of a color document image, an M color component of a color document image and a Y color component of a color document image are respectively inputted into the laser beam writing devices 227*b*, 227*c*, and 227*d*.

This results in formation of electrostatic latent images on the respective photosensitive drums 222*b*, 222*c*, and 222*d*, the electrostatic latent images respectively corresponding to color converted document image information. The electrostatic latent images respectively formed on the photosensitive drums 222*b*, 222*c*, and 222*d* by the laser beam writing devices 227*b*, 227*c*, and 227*d* are developed with respective color toners contained in the respective developer container sections 24*b*, 24*c*, and 24*d* provided in the developing devices 224*b*, 224*c*, and 224*d*. This reproduces the color converted image information as respective color toner images at the image forming section 210.

The discharging lamps 229*b*, 229*c*, and 229*d* are discharging means so as to always charge the surfaces of the photosensitive drums 222*b*, 222*c*, and 222*d* to uniform surface potential. The discharging lamps 229*b*, 229*c*, and 229*d* remove charge from the surfaces of the photosensitive drums 222*b*, 222*c*, and 222*d* after the residual toners are removed (cleaned off) from the surfaces by the cleaning devices 226*b*, 226*c*, and 226*d*.

The image forming station Px includes a charger 223*x* (charging means), a developing device 224*x* (developing means), a laser beam writing device 227*x* (a writing device, writing means) and a discharging lamps 228 (discharging means). The image forming station Px may have other elements.

With the intermediate transfer belt 216 interposed between them and the driving roller 215, the charger 223*x*, the developing device 224*x* and the discharging lamps 228 are provided around the driving roller 215 in this order from an upstream in accordance with the rotation direction of the driving roller 215. Moreover, the laser beam writing device 227*x* is provided at a position apart from the driving roller 215, the position between the charger 223*x* and the developing device 224*x*.

The charger 223*x* is arranged to uniformly charge, to predetermined potential, the surface of the intermediate transfer belt 216 before exposure. Although in this embodiment, a scorotron is used as the chargers 223*x*, the present embodiment of the present invention is not limited to this. A charging roller, a charging brush or the like may be used.

The developing device 224*x* develops an electrostatic latent image formed on the surface of the intermediate transfer belt 216 to a toner image.

The developing device 224*x* includes a developer container section 24*x* that contains a k color developer and a developing roller 25*x* that supplies the toner (the developer) contained in the developer container section 24*x* to the intermediate transfer belt 216. In the developing device 224*x*, the developing roller 25*x* is arranged to face the surface of the intermediate transfer belt 216.

The laser beam writing device 227*x* is a writing device (writing means, exposure means) that exposes the intermediate transfer belt 216 and forms an electrostatic latent image on the surface of the intermediate transfer belt 216. The laser beam writing device 227*x* has the same structure as the above-mentioned laser beam writing devices 227*b*, 227*c*, and 227*d*. However, in the laser beam writing device 227*x* a pixel signal corresponding to a K color component image of a color document image is inputted and the electrostatic latent image corresponding to the color converted document image information of the pixel signal is formed on the intermediate transfer belt 216.

The electrostatic latent image formed on the intermediate transfer belt 216 by the laser beam writing device 227*x* is developed with a K color toner contained in the developer container section provided in the developing device 224*x*. In this way, the document image information color converted at the image forming section 210 is reproduced as a K color toner image in the K color.

In contrast with the above-mentioned image forming stations Pb, Pc, and Pd that form toner images on the surfaces of the photosensitive drums 222*b*, 222*c*, and 222*d* and transfer, to the intermediate transfer belt 216, the toner images formed on the surfaces of these photosensitive drums 222*b*, 222*c*, and 222*d*, the image forming station Px forms the toner image directly on the surface of the intermediate transfer belt 216.

In this way, according to the digital color copying machine 10 of the present embodiment of the present invention, the intermediate transfer belt 216, that is, an intermediate transfer member, functions as a latent image carrier. This reduces the number of the photosensitive drums (latent image carriers) and, along with this, the number of components such as the cleaning devices (cleaning means) and the primary transfer rollers (transfer means) and the like can be reduced. As the result, the digital color copying machine 10 can be downsized (downsized).

Namely, the image forming station Px does not include a cleaning device (cleaning means). In this embodiment, the cleaning device 221 provided around the driven roller 214 plays the same roll as the cleaning devices 226*b*, 226*c*, and 226*d* in the image forming stations Pb, Pc, and Pd.

The cleaning device 221 is a belt cleaning device that removes residual toners on the intermediate transfer belt 216 and includes, for example, a cleaning blade that is positioned to be in contact with the surface of the intermediate transfer belt 216 so as to scrape off residual toners on the surface of the intermediate transfer belt 216. The cleaning device 221 is provided, for example, around the driven roller 214, more particularly, between the secondary transfer section 230 and the tension roller 231.

The tension rollers 231 and 232 adjust the tension of the intermediate transfer belt 216 and provide suitable tension to the intermediate transfer belt 216 so that the intermediate transfer belt 216 can carry out rotation operation smoothly in relation to the driven roller 214.

In this embodiment, the cleaning device 221, the tension rollers 231 and 232, the image forming station Px, the image forming stations Pb, Pc, and Pd and the primary transfer rollers 225*b*, 225*c*, and 225*d* and the secondary transfer roller 202 are arranged in this order around the intermediate transfer belt 216, in the downstream from the driven roller 214 in a rotation direction of the intermediate transfer belt 216 via the part where the intermediate transfer belt 216 is wound around the driving roller 215, the intermediate transfer belt 216 provided in a substantially horizontal direction.

The primary transfer rollers 225*b*, 225*c*, and 225*d* are respectively pressure rollers positioned to oppose to the photosensitive drums 222*b*, 222*c*, and 222*d* in the respective image forming stations Pb, Pc, and Pd via the intermediate transfer belt 216. The primary transfer rollers 225*b*, 225*c*, and 225*d* transfer the toner images (the primary transfer process), which are formed on the surfaces of the respective photosensitive drums 222*b*, 222*c*, and 222*d*, to the intermediate transfer belt 216 by bringing the intermediate transfer belt 216, by applying pressure, into contact with the development surfaces of the respective photosensitive drums 222*b*, 222*c*, and 222*d*.

Moreover, the driven roller 214 has another function as a transfer roller: the driven roller 214 works together with the secondary transfer roller 202 in order to perform the secondary transfer. In other words, the driven roller 214 and the secondary transfer roller 202 constitute the secondary transfer section 230.

The secondary transfer roller 202 is provided at a position being opposed to the driven roller 214 via the intermediate transfer belt 216. The position is located along the recording medium transport route 206.

This results in transferring a superimposed image (a full-color image) that is formed on the intermediate transfer belt 216 by four color toners to the fed recording paper P at the secondary transfer section 230 after an image transfer (the primary transfer process) has been completed at the image forming station Pd.

The intermediate transfer belt 216 is friction-driven toward a nip section (the secondary transfer section 230) between the driven roller 214 and the secondary transfer roller 202 via transfer nips which are formed by abutment of the photosensitive drums 222*b*, 222*c*, and 222*d* in the image forming stations Pb, Pc, and Pd and the secondary transfer roller 202.

In this embodiment, it is preferable that the intermediate transfer belt 216 be arranged such that writing-in of the image is performed at a portion thereof supported by a supporting member (the driving roller 215 in this embodiment) that bears the intermediate transfer belt 216, namely, a portion thereof where the intermediate transfer belt 216 abuts the driving roller 215. Because of this, the image forming station Px is provided around the driving roller 215 as mentioned above, in the present embodiment.

According to this embodiment, carrying out electrostatic latent image formation and electrostatic latent image visualization at the portion supported by the driving roller 215 makes it possible to carry out suitable visualization because a position on writing surface, namely, an visualizing position on the surface of the intermediate transfer belt 216 becomes stable.

The conductive driving roller 215 (the supporting member) makes it possible that photoconductive characteristic of a photosensitive layer 216*d* formed on the intermediate transfer belt 216 is exerted adequately because the driving roller 215 can function as a conductive base in the latent image carrier. This results in being able to carry out suitable visualization.

Referring to FIGS. 2 to 5, structures of the photosensitive drums 222*b*, 222*c*, and 222*d* as image carriers and the intermediate transfer belt 216 of this embodiment are explained as follows.

Figure 2:
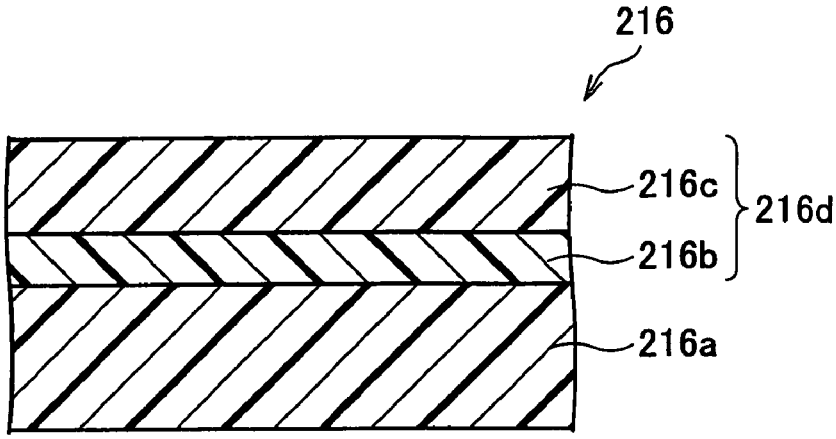
FIG. 2 is a sectional view schematically illustrating a structure of the intermediate transfer belt of FIG. 1.
Figure 3:
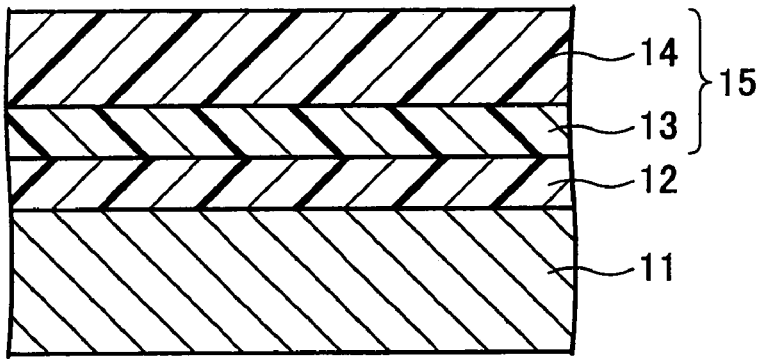
FIG. 3 is a sectional view schematically illustrating a structure of a photosensitive drum in FIG. 1.

FIG.2 is a sectional view schematically illustrating a structure of the intermediate transfer belt 216 of the present embodiment. FIG.3 is a sectional view schematically illustrating a structure of the photosensitive drums 222*b*, 222*c*, and 222*d* of the present embodiment.

Any of the photosensitive drums 222*b*, 222*c*, and 222*d* of this embodiment, as illustrated in FIG. 3, has a structure including a base 11 (base member) and a photosensitive layer 13 formed on the periphery of the base 11. The base 11 is a cylindrical metal base tube that is made of metal such as aluminum or the like. The photosensitive layer 15 includes a charge generating layer (herein, denoted by a GCL layer) 13 and a charge transporting layer (herein, denoted by a CTL layer) 14 which are laminated in this order with a blocking layer 12 interposed therebetween. General photoreceptors also have the structure schematically illustrated in FIG. 3.

The blocking layer 12 insulates the metal, that is, the base 11, by an oxidized film or an insulation film. By adjusting the photoconductive characteristic (resistance values of the photosensitive drums 222*b*, 222*c*, and 222*d*), the blocking layer 12 prevents formation of a pinhole and the like due to destruction of insulation in the photosensitive layer 15. When the layer is made of an oxidized film, the thickness of the blocking layer formed is substantially several μm to 10 μm.

The photosensitive layers 15 including the GCL layers 13 and the CTL layers 14 of the photosensitive drums 222*b*, 222*c*, and 222*d* have layer thickness of substantially 20 μm and volumetric resistance values of $10^{11}$ Ω·cm.

The CGL layers 13 generate charge when laser is incident thereon from the laser beam writing device 227*b*, 227*c*, and 227*d*.

The CTL layers 14 are outermost layers of the photosensitive drums 222*b*, 222*c*, and 222*d* and on the surface of the CTL layers 14 the electrostatic latent images are formed. The toner images are formed by developing the electrostatic latent images by the developing devices 224*b*, 224*c*, and 224*d*.

The layer thickness of each layer (the CGL layer 13 and the CTL layer 14) included in the photosensitive layer 15 may be determined depending on desirable length of life and resolution of the electrostatic latent image. The layer thickness, thus, is not limited specifically.

The intermediate transfer belt (photoreceptor-cum-intermediate transfer belt) of the present embodiment has a structure including a base member 216*a* and a photosensitive layer 216*d*. A resin film used as the base member 216*a* is PI (polyimide), PC (polycarbonate) or the like, whose volume resistance is $10^{11}$Ω·cm and whose thickness is 50 μm. The photosensitive layer 216*d* is provided by forming, on the surface of the base member 216*a*, a CGL layer 216*b* and a CTL layer 216*c* in this order from the base member 216*a*.

The CGL layers 216*b* and the CTL layers 216*c* are formed in the same manner as the photosensitive layers 15 which are made of the CGL layers 13 and the CTL layers 14 of the photosensitive drums 222*b,* 222*c,* and 222*d.* Namely, although the intermediate transfer belt 216 uses, for its layer that is its base (a base member), a different material from the photosensitive drums 222*b,* 222*c,* and 222*d,* the intermediate transfer belt 216 includes the same structure as those of the photosensitive drums 222*b,* 222*c,* and 222*d* except that the blocking layers 12 are omitted in the intermediate transfer belt 216.

Accordingly, according to this embodiment, the CGL layer 216*b* is also arranged to generate charge when laser is incident thereon from the laser beam writing device 227*x.* It is also possible to form a toner image on the surface of the intermediate transfer belt 216 by development of the electrostatic latent image formed on the surface of the CTL layer 216*c* by the use of the developing devices 224*x.*

Figure 4:
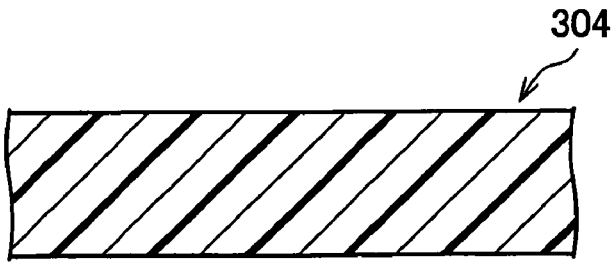
FIG. 4 is a sectional view schematically illustrating a structure of a conventional intermediate transfer belt mechanism.

On the contrary, as illustrated in FIG. 4, a conventional intermediate transfer belt 304 includes a single layer structure of a base member that is made of a resin film. The conventional intermediate transfer belt 304 does not include a photosensitive layer on the surface of the belt 304, namely, does not include the CGL layer and the CTL layer.

Figure 8:
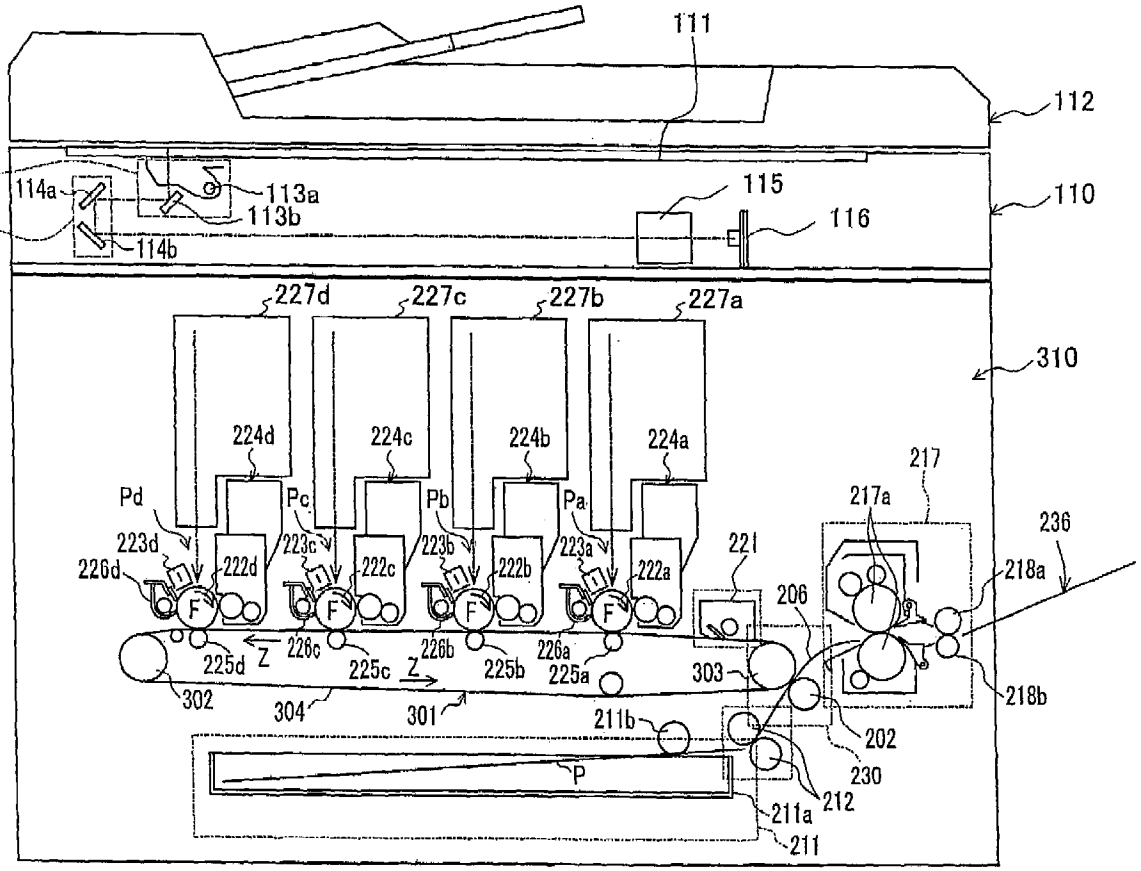
FIG. 8 is a sectional view schematically illustrating a structure of a conventional image forming device.

Accordingly, the conventional intermediate transfer belt 304 cannot function as a photoreceptor (a latent image carrier) but requires the same number of photoreceptors (photosensitive drums 222*a,* 222*b,* 222*c,* and 222*d*) as the number of colors KCMY in a case where K, C, M and Y color toner images are formed as illustrated in FIG. 8. Moreover, compared with the digital color copying machine 10 of the present embodiment of the present invention, a digital color copying machine as in FIG. 8 further requires an additional primary transfer roller 225*a* that is opposed to a cleaning device 226*a* removing (cleaning) residual toner on the surface of a photosensitive drum 222*a* and the photosensitive drum 222*a* because the digital color copying machine needs the additional photosensitive drum 222*a.*

Therefore each of image forming stations Pa, Pb, Pc, and Pd provided in an image forming section 310 of the digital color copying machine as in FIG. 8 has a substantially identical structure. In other words, the image forming station Pa in the digital color copying machine as in FIG. 8 has a structure including each of the photosensitive drum 222*a,* a charger 223*a,* a developing device 224*a,* the cleaning device 226*a,* a laser beam writing device 227*a* and a discharging lamps that is not illustrated in FIG. 8.

According to the present embodiment of the present invention, the use of the intermediate transfer belt 216 as a latent image carrier becomes possible by including the photosensitive layer 216*d* on the surface of the base member 216*a* of the intermediate transfer belt 216. This makes it possible to realize downsizing the device and lowering cost of the device as well as reducing the number of component parts. In other words, in this embodiment, one of the primary transfer processes transferring images from the latent image carriers (the photosensitive drums) to the intermediate transfer belt 216 can be eliminated by giving, to the intermediate transfer belt 216, photoconductive characteristic as a latent image carrier and causing the intermediate transfer belt 216 to function as a latent image carrier. This results in reducing component parts such as cleaning means, transfer means and the like, which are necessary as many as the number of transfer processes, in other words, as many as number of photosensitive drums (latent image carriers), and makes it possible to downsize the device.

In the intermediate transfer belt 216, according to the present embodiment, a resin film, that is, a base member 216*a,* functions as a blocking layer. Because of this, a blocking layer is not necessary to the intermediate transfer belt 216 though the photosensitive drums 222*b,* 222*c,* and 222*d* need blocking layers.

Though conductive resin made of resin such as PC (polycarbonate), PI (polyimide) or the like is suitably used as a base member 216*a* material of the intermediate transfer belt 216, PA (polyamide), PVDF (polyvinylidence difluoride), ETFE (ethylene-tetrafluoroethylene copolymer) or the like may be used. The thickness of the base member 216*a* may be, for example, substantially 50 μm to 200 μm.

The primary transfer rollers 225*b,* 225*c,* and 225*d* and the secondary transfer roller 202 have structures in which the cores are used as base materials and conductive layers made of conductive reason are formed on the surface of the rollers 225*b,* 225*c,* 225*d,* and 202.

As the above conductive layer, polyurethane, EPDM (ethylene-propylene diene terpolymer), CR (chloroprene rubber), NR (natural rubber), NBR (acrylonitrile butadiene copolymer), silicone rubber or the like can be used.

Hardness of rubber sections (conductive layers) in the primary transfer rollers 225*b,* 225*c,* and 225*d* and the second transfer roller 202 are, in general, 15° to 80°. When the rubber sections are thick with respect to the core parts, rubber of the primary transfer roller 225*b* need have a hardness of more than 50° in the state that the rubber is fixed around the core of the primary transfer roller 225*b.*

The electrical resistance (volume resistance rate) of the primary transfer rollers 225*b,* 225*c,* and 225*d* and the second transfer roller 202 is between $10^2$ Ω·cm to $10^9$ Ω·cm.

The primary transfer rollers 225*b,* 225*c,* and 225*d* and the secondary transfer roller 202 may be brush-shaped rollers (transfer brushes) that are produced by implanting, on their core, conductive fibers used as the conductive layers. Fibers such as rayon, acryl, nylon and the like are examples of the above-mentioned fibers.

By a high voltage source that is not illustrated in FIGS., high voltage (transfer bias) is applied to these transfer rollers 225*b,* 225*c,* and 225*d* and the secondary transfer roller 202 in order to attract toner electrically. The voltage is from 0.5 kV to 4 kV. There are cases where the voltage is controlled, i.e., varied according to temperature and humidity of a surrounding where the digital color copying machine 10 is used.

From the aspect of the cost, in the present embodiment, it is desirable that the outer diameter of the driving roller 215 is determined so that (i) a curvature of the surface of the transfer belt 216, specifically, a curvature of a pitch circle of that portion of the intermediate transfer belt 216 in which the above driving roller 215 and the intermediate transfer belt 216 are in contact with each other and (ii) a curvature of the surfaces of the photosensitive drums 222*b,* 222*c,* and 222*d* are equal. Because the intermediate transfer belt 216 includes a multi-layer structure and Young's modulus of each layer differs, the pitch circle of the intermediate transfer belt 216 varies. In other words, depending on a difference in the Young's moduli, speed of the intermediate transfer belt 216 somewhat differs slightly. Accordingly, it is preferable that the curvature of the pitch circle of the intermediate transfer belt 216 and the curvature of the surface of the photosensitive drums 222*b,* 222*c,* and 222*d* be equal.

It becomes possible that main component parts for the charging means and the developing means at least are shared by determining the outer diameter of the driving roller 215 so that (i) the curvature of the pitch circle of the intermediate transfer belt 216 and (ii) the curvature of the surface of the photosensitive drums 222*b,* 222*c,* and 222*d* are equal, that is, by arranging that (i) the curvature of the pitch circle of the intermediate transfer belt 216 and (ii) the curvature of the surface of the photosensitive drums 222*b*, 222*c*, and 222*d* are equal.

However, the driving roller 215 need not be formed so that its outer diameter satisfies the above relation. For example, a slip of the intermediate transfer belt 216 at abutment area where the intermediate transfer belt 216 and the driving roller 215 are in contact (abutted) with each other can be prevented by determining the outer diameter of the driving roller 215 in a way that the curvature of the pitch circle of the intermediate transfer belt 216 becomes larger than the curvature of the surface of the photosensitive drums 222*b*, 222*c*, and 222*d* because determination of the outer diameter determined in this manner makes it possible to have a larger winding angle of the intermediate transfer belt 216 with respect to the driving roller 215 at the position where the intermediate transfer belt 216 and the driving roller 216 are in contact (abutted) with each other.

In this embodiment, it is preferable to determine the outer diameter of the driving roller 215 so that the curvature of the pitch of the intermediate transfer belt 216 and the curvature of the surface of the photosensitive drums 222*b*, 222*c*, and 222*d* are equal as well as arranging that the same length is used for the following: (a) intervals between transfer nips among nips formed by that the intermediate transfer belt 216 comes into contact with the photosensitive drums 222*b*, 222*c*, and 222*d*; (b) distance between a latent image formation position on the intermediate transfer belt 216 to the transfer nip closest to the position; and (c) length of circumference of the photosensitive drums 222*b*, 222*c*, and 222*d*. The above-mentioned relation is explained in more details by referring to FIG. 5 as follows.

Figure 5:
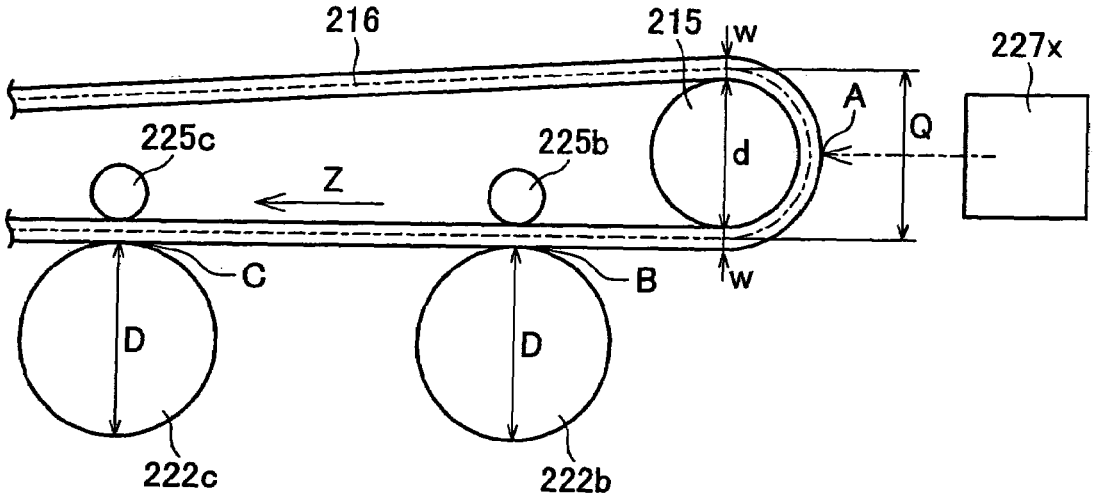
FIG. 5 is a sectional view schematically illustrating a structure of various parts of the intermediate transfer belt mechanism in FIG. 1.

FIG. 5 is a cross-sectional view schematically illustrating an arrangement of the intermediate transfer belt mechanism 213 in the digital color copying machine 10.

As shown in FIG. 5, it is preferable the digital color copying machine 10 according to the present embodiment be arranged so that: a distance (interval) between an image writing point A and a transfer nip B, a distance between the transfer nip B and a transfer nip C are equal to length of circumferences of the photosensitive drums 222 and 222*c*, where the image writing point A is a laser irradiation position (electrostatic latent image formation position) (which is that position on a surface of the intermediate transfer belt 216 on which a laser beam from the laser beam writing device 227*x* is incident, and the transfer nip B is a position where the intermediate transfer belt 216 and the photosensitive drum 222*b* are tangent with each other, and the transfer nip C is a position where the intermediate transfer belt 216 and the photosensitive drum 222*c* are tangent with each other.

Further, as shown in FIG. 5, it is desirable that the digital color copying machine 10 be arranged such that: Q=d+w, and D≈Q (i.e., D≈d+w) (i.e., a pitch circle curvature of the intermediate transfer belt 216 is equal to a surface curvature of each of the photosensitive drums 222*b* and 222*c*), where D is a diameter of each of the photosensitive drums 222*b* and 222*c*, d is a diameter of the driving roller 215, w is a thickness of the intermediate transfer belt 216, Q is a pitch circle diameter of the intermediate transfer belt 216. In the present invention, a pitch circle of the intermediate transfer belt 216 is a circle equivalent to a position of a pitch line of the intermediate transfer belt 216 wound on the driving roller 215, i.e., a position of a center line, equivalent to ½ of a thickness (w) of the intermediate transfer belt 216, of the intermediate transfer belt 216. The pitch circle of the intermediate transfer belt 216 varies depending on a difference in a Young's modulus among layers forming the intermediate transfer belt 216.

Similarly, it is desirable that (a) a distance (interval) from (i) a transfer nip between the photosensitive drum 222*d* and the intermediate transfer belt 216 to (ii) the transfer nip C, (b) a length of circumference of the photosensitive drum 222*d* be also equal to the distance (interval) from the image writing point A to the transfer nip B, the distance (interval) from the transfer nip B to the transfer nip C, and the length of circumference of each of the photosensitive drums 222*b* and 222*c*. Further, it is desirable that D≈d+w (i.e., a pitch circle curvature of the intermediate transfer belt 216 is equal to a surface curvature of each of the photosensitive drums 222*b*, 222*c*, and 222*d*) where D is a diameter of each of the photosensitive drums 222*b*, 222*c*, and 222*d*, d is a diameter of the driving roller 215, w is a thickness of the intermediate transfer belt 216.

The digital color copying machine 10 is arranged as follows: (a) respective intervals between each nip, (b) the distance from the image writing point A on the intermediate transfer belt 216 to the transfer nip B on the photosensitive drum 222*b*, which is the nearest photosensitive drum to the image writing point A in a downstream with respect to a rotation direction of the intermediate transfer belt 216, and (c) the length of circumference of each of the photosensitive drums 222*b*, 222*c*, and 222*d* are equal; the diameter d of the driving roller 215, which is that one of the driving rollers associated with the electrostatic latent image formation and which supports the intermediate transfer belt 216 at the image writing point A in such a manner that the intermediate transfer belt 216 is tensioned, are equal to a difference between the diameter D of the photosensitive drums 222*b*, 222*c*, and 222*d* and the thickness w ($=\{w\times 1/2\}\times 2$) of the intermediate transfer belt 216. In this way, in the digital color copying machine 10, a phase of rotation unevenness of each of the photosensitive drums 222*b*, 222*c*, and 222*d* can be synchronized with a phase of rotation movement unevenness of the intermediate transfer belt 216. Therefore, when an image is formed, a phase of unevenness of one image forming station can be synchronized with a phase of unevenness of another image forming station (i.e., a phase of unevenness occurring at one image formation point can be synchronized with a phase of unevenness occurring at another image formation point). As a result, color misregistration can be alleviated to less conspicuous.

Further, in the present embodiment, it is desirable that at least that portion (supporting section) of the driving roller 215 which is to be in contact (contactable) with the intermediate transfer belt 216 is conductive, and be grounded or have a potential whose polarity is reverse to a polarity of a charge of each of the photosensitive drums 222*b*, 222*c*, and 222*d*.

Since the intermediate transfer belt 216 has a photoconductive property (charging property) as a photoreceptor, a residual potential remains on a surface of the intermediate transfer belt 216 as a result of application of a transfer voltage for an image transfer. A high residual potential has a bad influence on the primary transfer performed by image forming stations Pb, Pc, and Pd in the downstream, so that a good image formation may be impossible.

Therefore, in order to form a good image, it is desirable that the residual potential be attenuated or removed as quickly as possible.

For this reason, the driving roller 215 is arranged such that at least that portion thereof to be in contact (contactable) with the intermediate transfer belt 216 is conductive, and that portion is grounded or has a potential whose polarity is reverse to the polarity of the charge of each of the photosensitive drums 222*b*, 222*c*, and 222*d*, or have a potential which is in the same polarity as the polarity of the charge of each of the photosensitive drums 222*b*, 222*c*, and 222*d* but is closer to the other polarity (i.e. less positive or less negative). This accelerates the attenuation of a surface potential obtained by the charging property of the intermediate transfer belt 216 and image writing (electrostatic latent image formation), thereby enabling good image formation.

When the intermediate transfer belt 216 or the photosensitive drums 222*b*, 222*c*, and 222*d* are negatively (−) charged, the toner is positively (+) charged in case of normal development and is negatively (−) charged in case of reversal development. Although the present embodiment describes a case of reversal development by way of an example in, the present invention is not limited thereto.

According to the present embodiment, for example, the driving roller 215 is arranged as to be grounded or to have a positive (+) potential, so that a residual potential remaining on a surface of the intermediate transfer belt 216 can be attenuated at a faster rate. The driving roller 215 may be so arranged as to have a negative (−) potential but is less negative than the surface voltage of the intermediate transfer belt 216 and the surface voltage of each of the photosensitive drums 222*b*, 222*c*, and 222*d*. This arrangement is also effective to allow accelerated attenuation of the residual potential, albeit not as quickly as the arrangement where the driving roller 215 is grounded or has a positive (+) potential.

In the following, image formation operation in the digital color copying machine 10 will be described.

Although the following describes, by way of example, the case in which the four-color toner image is formed by using the image forming stations Px, Pb, Pc, and Pd, the present invention is not to be limited to this.

Document image data read by the image reading device 110 is transmitted to an image processing section (not shown). Then the document image data is subjected to a predetermined image data processing, and then outputted to the respective laser beam writing devices 227*x*, 227*b*, 227*c*, and 227*d* of the image forming stations Px, Pb, Pc, and Pd.

Because the image data corresponds to each of the K, C, M, and Y colors, image data corresponding to the K color, image data corresponding the C color, image data corresponding the M color, and image data corresponding the Y color are outputted to the image forming stations Px, Pb, Pc, and Pd, respectively.

A toner image of each of the colors is formed in each of the image forming stations Px, Pb, Pc, and Pd and is superimposed to form a superimposed image on the intermediate transfer belt 216. However, a transfer step is not necessary in the image forming station Px, since a K-color image serving as a first-color image is formed directly on the intermediate transfer belt 216 serving as an intermediate transfer belt-cum-photoreceptor.

Next, in the image forming stations Pb, Pc, and Pd, a second-, third-, and a fourth-color images are formed sequentially on the photosensitive drums 222*b*, 222*c*, and 222*d* and are transferred sequentially onto the K-color image, which has already been formed. That is, the second-color (e.g., C-color) toner image formed on the photosensitive drum 222*b*, on which an image is to be formed, is transferred to the intermediate transfer belt 216 by a transfer voltage (e.g., 1.5 kv) applied to the primary transfer roller 225*b*. Then, in timing with a third-color transfer, the third-color (e.g., M-color) toner image formed on the photosensitive drum 222*c* is transferred to the intermediate transfer belt 216 by a transfer voltage (e.g., 1.5 kv) applied to the primary transfer roller 225*c*. Finally, in timing with a fourth-color transfer, the fourth-color (e.g., Y-color) toner image formed on the photosensitive drum 222*d* is transferred to the intermediate transfer belt 216 by a transfer voltage (e.g., 1.5 kv) applied to the primary transfer roller 225*d*. This forms a full-color image formed by superimposing the four colors (K, C, M, and Y colors) on one another.

In the digital color copying machine 10 according to the present embodiment, paper in a form of cut sheet is used as the recording paper P. When the paper P is ejected from the paper feeding cassette 211*a* by the paper feeding mechanism 211 and is fed to the recording medium transport route 206 of the paper feeding mechanism 211, a tip of the paper P is detected by a sensor (not shown), and the paper P is halted temporarily by a pair of registration rollers 212 in accordance with a detection signal outputted from the sensor.

Thereafter, in synchronism with the intermediate transfer belt 216 rotating in the direction of the arrow Z shown in FIG. 1 in synchronism with the timing of each of the image forming stations Px, Pb, Pc, and Pd, the paper P is sent to the nip section (secondary transfer nip section 230) between the driven roller 214 and the secondary transfer roller 218.

A photosensitive layer 216*d* of the intermediate transfer belt 216 is negatively charged by a charger 223*x*.

In the image forming stations Px, Pb, Pc, and Pd, the laser beam writing devices 227*x*, 227*b*, 227*c*, and 227*d* follow a normal image formation process to form electrostatic latent images on the intermediate transfer belt 216 and the respective surfaces of and the photosensitive drums 222*b*, 222*c*, and 222*d*. The electrostatic latent images respectively correspond to the colors of the toners respectively stored in developer storage sections 24*x*, 24*b*, 24*c*, and 24*d* in development devices 224*x*, 224*b*, 224*c*, and 224*d* in the image forming stations Px, Pb, Pc, and Pd. That is, based on the image data (image signals) respectively corresponding to the K, C, M, Y colors, the electrostatic latent images respectively corresponding to the K, C, M, Y colors are written on the respective surfaces of the intermediate transfer belt 216 and the photosensitive drums 222*b*, 222*c*, and 222*d*.

Specifically, the surface of the intermediate transfer belt 216 and the respective surfaces of the photosensitive drums 222*b*, 222*c*, and 222*d* are uniformly charged by the chargers 223*x*, 223*b*, 223*c*, and 223*d*. The laser beam writing devices 227*x*, 227*b*, 227*c*, and 227*d* radiate laser beams, each based on each of the colors, upon the surface of the intermediate transfer belt 216 and the respective surfaces of the photosensitive drums 222*b*, 222*c*, and 222*d*. In this way, the surface of the intermediate transfer belt 216 and the respective surfaces of the photosensitive drums 222*b*, 222*c*, and 222*d* are scanned over. As a result, a first scan by the laser beams and a slow scan by a rotation of the intermediate transfer belt 216 and respective rotations of the photosensitive drums 222*b*, 222*c*, and 222*d* cause the electrostatic latent images to be formed on the surface of the intermediate transfer belt 216 and the respective surfaces of the photosensitive drums 222*b*, 222*c*, and 222*d*, the electrostatic latent images each corresponding to each of the colors.

The electrostatic latent images formed on the surface of the intermediate transfer belt 216 and the respective surfaces of the photosensitive drums 222*b*, 222*c*, and 222*d* are visualized by being developed with developers (toners), respectively corresponding to the colors, by the development devices 224*x*, 224*b*, 224*c*, and 224*d*, so that respective toner images of the colors are formed on the surface of the intermediate transfer belt 216 and the respective surfaces of the photosensitive drums 222*b*, 222*c*, and 222*d*.

Moreover, the toner images, respectively corresponding to the colors, which are formed on the respective surfaces of the photosensitive drums 222*b*, 222*c*, and 222*d* are superimposed on the intermediate transfer belt 216 along with a rotation of the intermediate transfer belt 216 in the direction of the arrow Z.

Specifically, first, in the image forming station Px located in the most upstream position among the image forming stations Px, Pb, Pc, and Pd in the rotation direction of the intermediate transfer belt 216, a K-color toner image is formed on the intermediate transfer belt 216. A discharging lamp 228 removes an electric charge from the intermediate transfer belt 216 on which the K-color toner image is formed, so as to allow good transfer of the toner images in different colors formed by the following image forming stations Pb, Pc, and Pd located in the downstream of the image forming station Px in the rotation direction of the intermediate transfer belt 216.

Then, in accordance with the rotation of the intermediate transfer belt 216, the K-color toner formed on the surface of the intermediate transfer belt 216 moves to the next image forming station Pb, which performs primary transfer of the C-color toner image to cause the C-color toner image to be superimposed on the K-color toner image formed on the surface of the intermediate transfer belt 216. Thereafter, in accordance with the rotation of the intermediate transfer belt 216, the image forming stations Pc, and Pd performs primary transfer to cause the M- and Y-color toner images respectively to be superimposed on the toner image having already been transferred on the surface of the intermediate transfer belt 216. This forms on the intermediate transfer belt 216 a multilayer toner image, i.e. a multicolor image, including the K, C, M, and Y colors superimposed in this order from the intermediate transfer belt 216.

The full-color (four-color-toner) image formed on the intermediate transfer belt 216 by finishing the image transfer by the image forming station Pb is sent to the nip section (secondary transfer section 230) between the secondary transfer roller 202 and the driven roller 214 in accordance with the rotation of the intermediate transfer belt 216 in the direction of the arrow Z.

Respective residual toners remaining on the respective surfaces of the photosensitive drums 222*b*, 222*c*, and 222*d* are removed by the cleaning devices 226*b*, 226*c*, and 226*d* respectively after the toner images have been transferred to the intermediate transfer belt 216. Thereafter, the discharging lamps 229*b*, 229*c*, and 229*d* electrically discharge the respective surfaces of the photosensitive drums 222*b*, 222*c*, and 222*d*. The respective surfaces of the photosensitive drums 222*b*, 222*c*, and 222*d* are so electrified that they have always a uniform surface potential. Then next image formation is performed sequentially. This makes it possible to always form an image satisfactorily without being affected by a transfer bias and the like, the transfer bias applied so as to transfer the toners onto the intermediate transfer belt 216.

The image transferred to the nip section (secondary transfer section 230) between the secondary transfer roller 202 and the driven roller 214 is transferred on the paper P by the secondary transfer section 230 in the following manner: The recording paper P, which has been ejected from the paper feeding mechanism 211 and then halted by the registration rollers 212, is delivered in timing with arrival of the image sent to the nip section (secondary transfer section 230) between the secondary transfer roller 202 and the driven roller 214. In accordance with the delivery of the recording paper P, a transfer voltage (e.g., 2.0 kV) is applied to the secondary transfer roller 202. In this way, the secondary transfer section 230 performs the transfer of the image on the recording paper P.

The recording paper P, on which the full-color multilayer toner image is thus formed, is further carried through the recording medium transport route 206 to the fixing device 217.

A residual toner remaining on the surface of the intermediate transfer belt 216 after the secondary transfer of the toner image to the paper P is removed by the cleaning device 221. Because the intermediate transfer belt 216 has a long length of circumference unlike an intermediate transfer roller, the application of the transfer voltage for the image transfer hardly causes the residual potential the surface of the intermediate transfer belt 216. However, in case where remaining of the residual potential is caused on the surface of the intermediate transfer belt 216, discharging means may be provided in the downstream of the secondary transfer section 230 in the rotation direction of the intermediate transfer belt 216, so as to discharge the intermediate transfer belt 216.

The paper P which has entered a nip section between the pair of fixing rollers 217*a* of the fixing device 217 is subjected to appropriately controlled heat (e.g., 170° C.) and pressure (e.g., a total load of 196 N (20 kgf)). This causes the multilayer toner image, formed on the paper P (for a secondary transfer), to be melted and mixed by heat and pressure so as to be fixed on the recording paper P.

The paper P on which the toner image is fixed is carried by the pair of ejection rollers 219 and is finally ejected to the feeder output tray 220 from the recording medium ejection outlet 205 provided above the feeder output tray 220. This completes the whole color image formation process.

Although in the present embodiment the developer used is a one-component developer containing a toner, the present invention is not limited to this and may be arranged such that a two-component developer containing a toner and a carrier is used. In the present embodiment, the K-color toner is used to form the K-color image, and the C-, M-, and Y-color toners are used to form C-, M-, and Y-color images respectively.

Further, in the present embodiment, the discharging lamps 228, 229*b*, 229*c*, and 229*d* are used as discharging means (discharging members). However, an discharging charger or the like can be used as the discharging means.

Moreover, although in the present embodiment the image forming station Px is provided with the discharging means such as the discharging lamp 228, the present invention is not limited this. The discharging means does not need to be used in case where the potential generated on the surface of the intermediate transfer belt 216 by the first image formation (i.e., the formation of the toner image by the image forming station Px) does not affect the transfer of the toner image formed in the subsequent image forming stations Pb, Pc, and Pd.

Further, although the present embodiment is arranged so that respective transfer voltages applied by the primary transfer rollers 225*b*, 225*c*, and 225*d* are set uniformly at 1.5 V, the present invention is not limited to this and may be arranged so that the applied voltages in the downstream is higher.

Moreover, although the present embodiment is arranged so that the supporting member (tension roller) located in association with the image forming station Px is the driving roller 215 which self-rotates so as to rotate the intermediate transfer belt 216, and the supporting member (tension roller) located in association with the secondary transfer section 230 is formed by the driven roller 214 which is driven by the rotation of the intermediate transfer belt 216 in accordance with the rotation of the driving roller 215, the present invention is not limited to this but only needs to be arranged so that at least one of the supporting members which support (tension) the intermediate transfer belt 216 self-rotates so as to rotate drive the intermediate transfer belt 216.

Further, although the present invention is arranged so that the intermediate transfer belt (belt member) 216 having the foregoing arrangement is used as the transfer image carrier (intermediate transfer member-cum-photoreceptor), the present invention is not limited to this and may be arranged so that the intermediate transfer drum (drum member) having a layered structure is used for example instead of the intermediate transfer belt 216.

However, when the transfer image carrier is a belt member rotatably tensioned by at least two supporting members as described above, it becomes possible not only to give a greater degree of freedom in layout of the image formation section 210 to make it easier to design, but also to further downsize the digital color copying machine 10, i.e., the image forming apparatus according to the present invention. Moreover, common units and parts can be used effectively, thereby reducing manufacturing cost and cost of maintenance parts.

Further, although the present embodiment is arranged so that the optical writing of the intermediate transfer belt 216 and the optical writing of each of the photosensitive drums 222*b*, 222*c*, and 222*d* are performed by using the laser beam writing devices 227*x*, 227*b*, 227*c*, and 227*d* to scan over the intermediate transfer belt 216 and the photosensitive drums 222*b*, 222*c*, and 222*d* with laser beams for exposure, the present invention is not to be limited to this. For example, as described in an embodiment to be described later, a laser beam scanner including a semiconductor laser element, a polygonal mirror (deflection device), an fθ lens, a mirror, and the like can be used as the laser beam writing devices 227*x*, 227*b*, 227*c*, and 227*d*. Further, instead of the laser beam scanner, a solid-scan writing device using a light emitting element such as an LED (light emitting diode), an EL (electro luminescence) or the like may be used. For example, a writing optical system (LED head) including an LED array and an image formation lens array can be used as such a solid-scan writing device. The LED head is smaller in size than the laser beam writing devices, and neither has movable part nor makes sound. Therefore, the LED head can be especially suitably used for an image forming apparatus such as a tandem digital color copying machine which requires a plurality of light writing units.

Further, the present embodiment describes, by way of example, the case where the image forming stations Px, Pb, Pc, and Pd are used to form a toner image (color image) formed with four colors: the K color and the three chromatic colors (the C, M, and Y colors). However, the present invention is not limited to this. In some cases, not all the four colors may not be used. Only the image forming station Px of the K color (first image forming station) may be used to form a monochrome image, and two or three of the colors may be used to form a multicolor image.

Moreover, although the image forming apparatus according to the present embodiment is arranged so that the electrical signal which has been converted from document image information read by the image reading section 110 is subjected to a predetermined image data processing in a image processing section (not shown), the present invention is not limited to this but may be arranged so that image data is inputted from a terminal device (not shown), e.g. a personal computer or the like, externally connected thereto. The image data thus inputted is also outputted to the image processing section, and used for image formation.

Although the digital color copying machine is described by way of example as one embodiment in the present embodiment, the present invention is not limited to this and is applicable for various image forming apparatuses such as a printer, a facsimile, and a copying machine.

Second Embodiment

Another exemplary embodiment of the present invention will be described below with reference to FIG. 6. For the purpose of convenience in description, components having the same functions as those described in the First Embodiment are given the same reference numerals, and explanations thereof are omitted. Also in the present embodiment, that although a digital color copying machine is described as an example of an image forming apparatus according to the present embodiment, the present invention is not limited to this.

Figure 6:
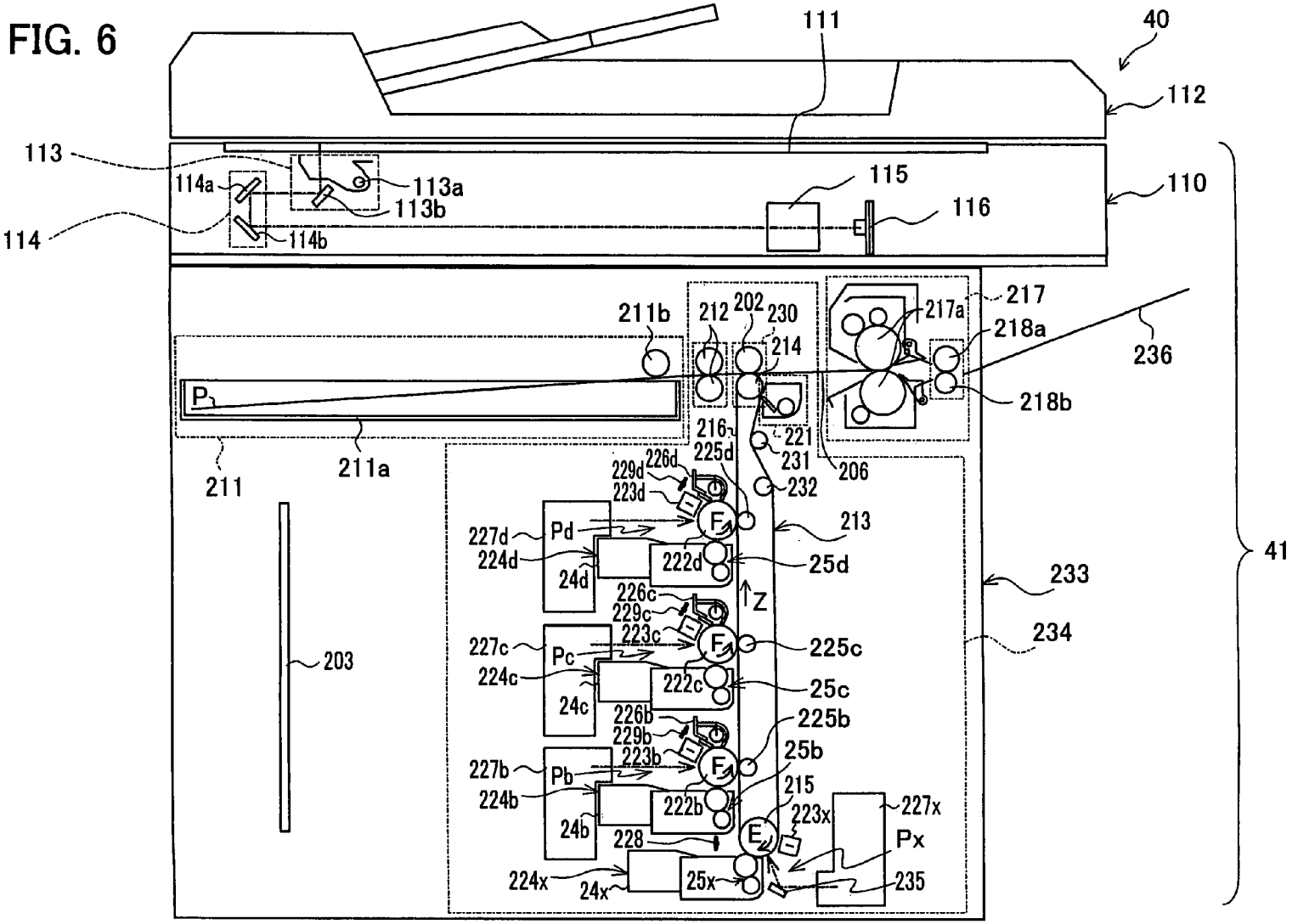
FIG. 6 is a sectional view schematically illustrating a structure of an image forming device of another exemplary embodiment of the present invention.

FIG. 6 is a cross-sectional view schematically illustrating an arrangement of a digital color copying machine 40 (image forming apparatus) according to the present embodiment.

As shown in FIG. 6, the digital color copying machine 40 according to the present embodiment has a copying machine main body 41 and a reversing automatic document feed (RADF) 112. The copying machine main body 41 is provided with an image reading section 110 and an image formation section 233 in an inside thereof. The reversing automatic document feed (RADF) 112 feeds a target document to the image reading section 110 in the copying machine main body 41. That is, the digital color copying machine 40 according to the present embodiment is arranged so as to have the image formation section 233 instead of the image formation section 210 according to the First Embodiment.

As shown in FIG. 6, the image formation section 233 in the digital color copying machine 40 according to the present embodiment has a feeder output tray 236 protruding through an upper part of an outer wall of the image formation section 233.

Further, provided in an upper inside of the image formation section 233 is a paper feeding cassette 211*a* in a paper feeding mechanism 211 opposite to the feeder output tray 236 with a fixing device 217 (fixing section) and a transfer device 234 (transfer section) therebetween.

The image formation section 223, as shown in FIG. 6, has, in an inside thereof, a paper feeding mechanism 211, and a recording medium transport route 206. The recording medium transport route 206 links the paper feeding mechanism 211 through the transfer device 234, the fixing device 217, a control section 203, the paper feeding mechanism 211, the transfer device 234, and the fixing device 217 with a feeder outlet (not shown).

In this way, the image formation section 233 according to the present embodiment in the copying machine main body 41 is arranged so that the recording medium transport route 206 is disposed in a substantially horizontal direction from a left (where paper feeding mechanism 211 side) in FIG. 6 to a right (feeder output tray 236 side) in FIG. 6, and (i) a pair of registration rollers 212 and (ii) a secondary transfer section 230, which are in the transfer device 234, and (iii) the fixing device 217 are provided in this order from the paper feeding mechanism 211 side along the recording medium transport route 206.

Also in the present embodiment, that the digital color copying machine 40 may be arranged as follows. The digital color copying machine 40 has a re-transportation route and an ejection roller. The paper P that has been subjected to the fixing device 217, that is, the paper P on one side of which an image is formed is transported via the re-transportation route to the transfer device 234 again in such a manner that, by (i) rotating the ejection roller in a reverse direction and (ii) switching transportation directions by using switching gate (transportation route switching means) or the like, an other side of the paper P faces the intermediate transfer belt 216 at a position of the transfer device 234. After images from the toner images are formed on both the sides of the paper P after subjecting the paper P to the fixing device 217 again, the paper P is ejected.

Also in the present embodiment, the transfer device 234 has an intermediate transfer belt mechanism 213, image forming stations Px, Pb, Pc, Pd, a pair of registration rollers 212, and a secondary transfer roller 202, and the secondary transfer section 230 includes the secondary transfer roller 202 and a driven roller 214 that is in the intermediate transfer belt mechanism 213.

Further, the intermediate transfer belt mechanism 213 has the driven roller 214 (supporting member), a driving roller 215 (supporting member), tension rollers 231 and 232, primary transfer rollers 225*b*, 225*c*, and 225*d* (primary transfer member, primary transfer means), the intermediate transfer belt 216 (belt member), and a cleaning device 221 (cleaning means). Around the intermediate transfer belt 216, the cleaning device 221, the tension rollers 231 and 232, the image forming station Px, the image forming stations Pb, Pc, and Pd, the primary transfer rollers 225*b*, 225*c*, and 225*d*, and the secondary transfer roller 202 are provided in this order from the driven roller 214, through that part of the driven roller 215 on which the intermediate transfer belt 216 is wound, toward a downstream in a rotation direction of the intermediate transfer belt 216.

However, in the present embodiment, the intermediate transfer belt 216 and the control section 203, extending from a lower side of the transfer device 234 to an upper side of the transfer device 234, are tensioned substantially perpendicularly to a direction in which the paper feeding cassette 211*a* and the recording medium transport route 206 are extended in the paper feeding mechanism 211.

According to the present embodiment, even when the components of the transfer device 234 are arranged as described above, as in the First Embodiment, the intermediate transfer belt 216 serving as an intermediate transfer member has a photoconductive property as a latent image carrier and functions as a photoreceptor-cum-intermediate transfer member, so that the number of photosensitive drums (latent image carriers) can be reduced. This makes it possible to reduce a number of cleaning devices (cleaning means) and a number of primary transfer rollers (transfer means), thereby downsizing the digital color copying machine 40.

Note that when the intermediate transfer belt 216 is extended (tensioned) in a vertical direction as shown in FIG. 6, it is desirable that the image forming station Px be arranged so that, as illustrated in FIG. 6, the laser beam writing device 227*x* (writing device, writing means) and a charger 223*x* (charging means) are disposed on one side (right side in FIG. 6) of the intermediate transfer belt 216, and the development device 224*x* (developing means) and a discharging lamp 228 (discharging means) are disposed on an other side (left side in FIG. 6) of the intermediate transfer belt 216, and the driving roller 215 is interposed therebetween. In this case, in order to send a laser beam from the laser beam writing device 227*x* upon the intermediate transfer belt 216, the image forming station Px may include a reflecting mirror 235 for reflecting the laser beam (light) from the laser beam writing device 227*x* so as to guide the laser beam to the intermediate transfer belt 216.

As illustrated in FIG. 6, the driving roller 215 is provided in a lowermost part of the copying machine main body 41, and the components of the image forming station Px disposed around the driving roller 215 are provided laterally to the driving roller 215, so that the digital color copying machine 40 can be more downsized.

Third Embodiment

A further embodiment of the present invention will be described below with reference to FIG. 7. For the purpose of convenience in description, components having the same functions as those described in the First and Second Embodiments are given the same reference numerals, and explanations thereof are omitted. In the present embodiment, a difference between the First and Second Embodiments will be mainly described. Also in the present embodiment, although a digital color copying machine is described as an example of an image forming apparatus according to the present embodiment, the present invention is not limited to this.

Figure 7:
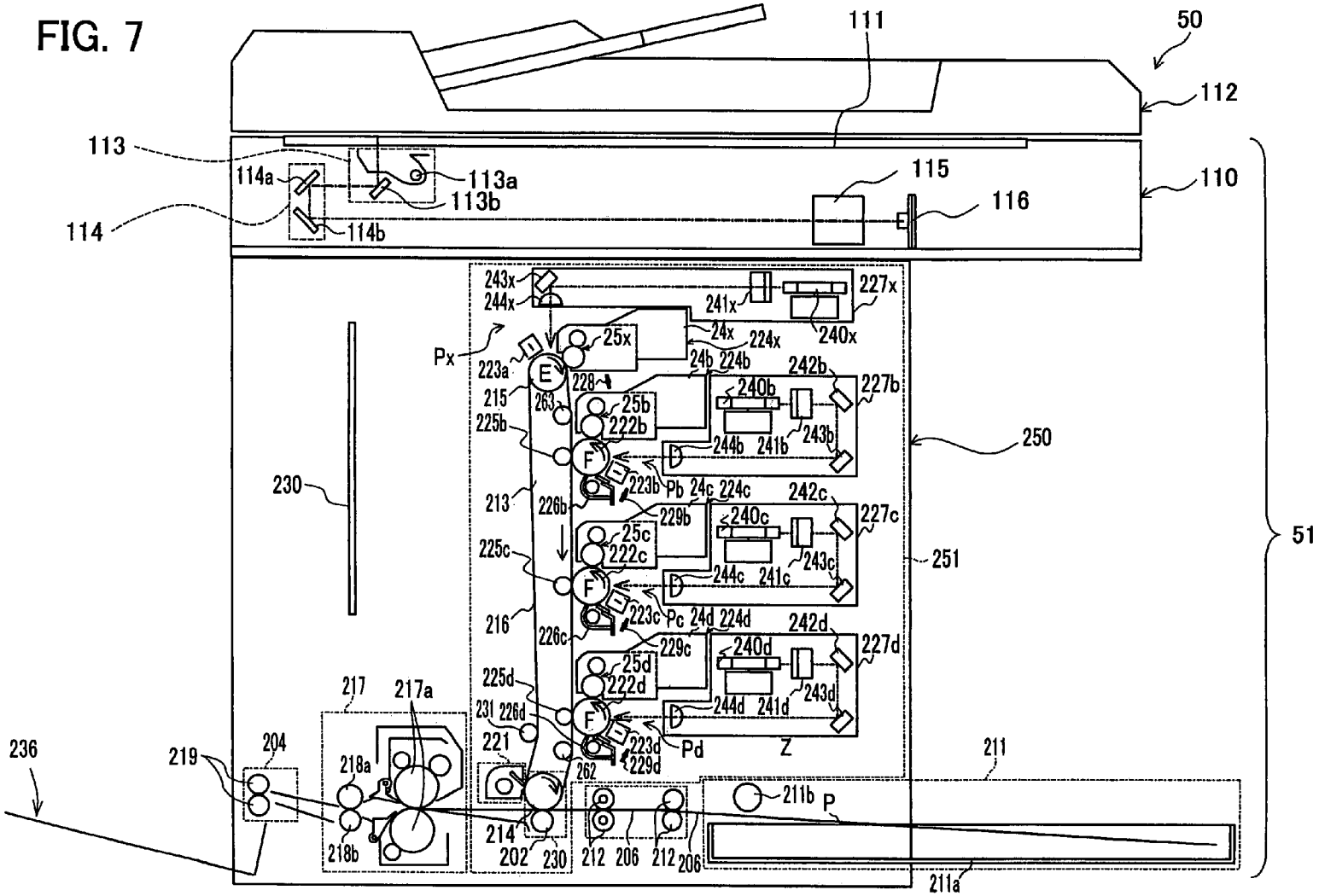
FIG. 7 is a sectional view schematically illustrating a structure of an image forming device of still another exemplary embodiment of the present invention.

FIG. 7 is a cross-sectional view of a schematic arrangement of a digital color copying machine 50 (image forming apparatus) according to the present embodiment.

As illustrated in FIG. 7, the digital color copying machine 50 according to the present embodiment has a copying machine main body 51 and a reversing automatic document feed (RADF) 112. The copying machine main body 51 is provided with an image reading section 110 and an image formation section 250 in an inside thereof. The reversing automatic document feed (RADF) 112 feeds a target document to the image reading section 110 in the copying machine main body 51. That is, the digital color copying machine 50 according to the present embodiment is arranged so as to have the image formation section 250 instead of the image formation section 210 according to the First Embodiment.

As illustrated in FIG. 7, the image formation section 250 in the digital color copying machine 50 according to the present embodiment has a feeder output tray 236 protruding through an outer wall side of the image formation section 250. However, in the present embodiment, the feeder output tray 236 is provided in a lower part (lower left part in FIG. 7) of the outer wall side of the image forming station 250.

Further, provided in an inside of the image formation section 250 is a paper feeding cassette 211*a* in a paper feeding mechanism 211 opposite to the feeder output tray 236 with an ejection section 204, a fixing device 217 (fixing section) and a transfer device 251 therebetween. A part of the paper feeding cassette 211*a* protrudes from another outer wall side of the image formation section 250.

The image formation section 250, as illustrated in FIG. 7, has a recording medium transport route 206 in an inside thereof. The recording medium transport route 206 links the paper feeding mechanism 211 through the transfer device 251, the fixing device 217, an ejection section 204 a control section 203, the paper feeding mechanism 211, the transfer device 251, and the fixing device 217 with the ejection section 204.

In this way, the image formation section 250 according to the present embodiment in the copying machine main body 51 is arranged so that the recording medium transport route 206 is disposed in a substantially horizontal direction from a right side (paper feeding mechanism 211 side) in FIG. 7 to a left side (feeder output tray 236 side) in FIG. 7, and registration rollers 212. In the transfer device 251, a secondary transfer section 230, the fixing device 217, and a pair of ejection rollers 219 in the ejection section 204 are provided in this order from the paper feeding mechanism 211 side along the recording medium transport route 206.

Also in the present embodiment, the digital color copying machine 50 may be arranged as follows. The digital color copying machine 50 has a re-transportation route. The paper P that have been subjected to the fixing device 217, that is, the paper P on one side of which an image is formed is transported via the re-transportation route to the transfer device 251 again in such a manner that, by (i) rotating the ejection rollers 219 in a reverse direction and (ii) switching transportation directions by using switching gate (transportation route switching means) or the like, an other side of the paper P faces the intermediate transfer belt 216 at a position of the transfer device 251. After images from the toner images are formed on both the sides of the paper P after subjecting the paper P to the fixing device 217 again, the paper P is ejected.

Also in the present embodiment, the transfer device 251 has an intermediate transfer belt mechanism 213, image forming stations Px, Pb, Pc, Pd, a pair of registration rollers 212, and a secondary transfer roller 202, and the secondary transfer section 230 includes the secondary transfer roller 202 and a driven roller 214 that is in the intermediate transfer belt mechanism 213.

Further, the intermediate transfer belt mechanism 213 has the driven roller 214 (supporting member), a driving roller 215 (supporting member), tension rollers 261, 262, and 263, primary transfer rollers 225*b*, 225*c*, and 225*d* (primary transfer member, primary transfer means), the intermediate transfer belt 216 (belt member), and a cleaning device 221 (cleaning means). Around the intermediate transfer belt 216, the cleaning device 221, the tension roller 261, the image forming station Px, the image forming stations Pb, Pc, and Pd, the primary transfer rollers 225*b*, 225*c*, and 225*d*, and the secondary transfer roller 202 are provided in this order from the driven roller 214, through that part of the driven roller 215 on which the intermediate transfer belt 216 is wound, toward a downstream in a rotation direction of the intermediate transfer belt 216.

Further, the tension roller 262 is provided between the primary transfer roller 225*b* and the driving roller 215, and the tension roller 263 is provided between the primary transfer roller 225*d* and the driven roller 214, both of the transfer rollers 262 and 263 being in contact with the intermediate transfer belt 216. The tension rollers 261, 262, and 263 has the same arrangements and functions as the tension rollers 231 and 232 described in the First Embodiment.

Further, a laser beam writing device 227*x* according to the present embodiment has a deflection device 240*x*, an fθ lens 241*x*, and various mirrors 243*x* and 244*x*. Further, a laser beam writing device 227*b* according to the present embodiment has a deflection device 240*b*, an fθ lens 241*b*, and various mirrors 242*b*, 243*b*, and 244*b*. Similarly, a laser beam writing device 227*c* according to the present embodiment has a deflection device 240*c*, an fθ lens 241*c*, and various mirrors 242*c*, 243*c*, and 244*c*. Similarly, a laser beam writing device 227*d* according to the present embodiment has a deflection device 240*d*, an fθ lens 241*d*, and various mirrors 242*d*, 243*d*, and 244*d*.

Each of the deflection devices 240*x*, 240*b*, 240*c*, and 240*d* has a semiconductor laser element and a polygonal mirror. The semiconductor laser element emits dot light modulated in accordance with image data. The polygonal mirror deflects the laser beam in a direction of a first scan, the laser beam emitted from the semiconductor laser element.

The fθ lens 241*x* and the various mirrors 234*x* and 244*x* cause a laser beam deflected by the polygonal mirror in the deflection device 240*x* to form an image on a surface of the intermediate transfer belt 216. The fθ lens 241*b* and the various mirrors 242*b*, 243*b*, and 244*b* cause a laser beam deflected by the polygonal mirror in the deflection device 240*c* to form an image on a surface of the photosensitive drum 222*b*. The fθ lens 241*c*, and the various mirrors 242*c*, 243*c*, and 244*c* cause a laser beam deflected by the polygonal mirror in the deflection device 240*c* to form an image on a surface of the photosensitive drum 222*c*. The fθ lens 241*d* and the various mirrors 242*d*, 243*d*, and 244*d* cause a laser beam deflected by the polygonal mirror in the deflection device 240*d* to form an image on a surface of the photosensitive drum 222*d*.

However, the laser beam writing devices 227*x*, 227*b*, 227*c*, and 227*d* are not to be limited by the foregoing arrangement. The various writing devices described in the First Embodiment can be used as the laser beam writing devices 227*x*, 227*b*, 227*c*, and 227*d*.

Further, also in the present embodiment, as with the Second Embodiment, the intermediate transfer belt 216 and the control section 203, extending from a lower side of the transfer device 251 to an upper side of the transfer device 251, are tensioned substantially perpendicularly to a direction in which the paper feeding cassette 211*a* in the paper feeding mechanism 211 and the recording medium transport route 206 are extended. However, in the present embodiment, as opposed to the Second Embodiment, the intermediate transfer belt 216 is arranged so that the driving roller 215 is provided in an upper part of the image formation section 250, and based on this, the image forming stations Px, Pb, Pc, and Pd are disposed in this order from the upper side of the image formation section 250 to a lower side of the image formation section 250.

Also in the digital color copying machine 50 according to the present embodiment, as with the First and Second Embodiments, the intermediate transfer device 216 serving as an intermediate transfer member has a photoconductive property as a latent image carrier and functions as an intermediate transfer member used also as a photoreceptor, so that the number of photosensitive drums (latent image carriers) can be reduced. This makes it possible to reduces the number of cleaning devices (cleaning means) and primary transfer rollers (transfer means), thereby downsizing the digital color copying machine 50.

Further, with the present embodiment, the image formation section 250 can be made smaller in width (slimmer). The paper feeding cassette 211*a* in the paper feeding mechanism 211 may be detachable.

As described above, an image forming apparatus of the present invention performing image formation by (1) transferring, to an intermediate transfer member, an image formed by visualizing a latent image formed on a latent image carrier, so as to superimpose the image on an image held on the intermediate transfer member in order to prepare an superimposition image on the intermediate transfer member, and then (2) transferring the superimposition image onto a recording medium, is arranged such that the intermediate transfer member has a latent image holding property for holding an electrostatic latent image; and an image formed on the intermediate transfer member by visualizing an electrostatic latent image formed on the intermediate transfer member is superimposed with the image formed by visualizing the electrostatic latent image formed on the latent image carrier.

In other words, an image forming apparatus of the present invention is for example an image apparatus including (i) a latent image carrier for holding an electrostatic latent image, and (ii) an intermediate transfer member for temporally holding an image formed by visualizing the electrostatic latent image formed on the latent image carrier, the image forming apparatus performing image formation by (1) transferring, to the intermediate transfer member, the image formed by visualizing the latent image formed on the latent image carrier, so as to superimpose the image on an image held on the intermediate transfer member in order to prepare an superimposition image on the intermediate transfer member, and then (2) transferring the superimposition image onto a recording medium, is arranged such that the intermediate transfer member has a latent image holding property for holding an electrostatic latent image; and an image formed on the intermediate transfer member by visualizing an electrostatic latent image formed on the intermediate transfer member is superimposed with the image formed by visualizing the electrostatic latent image formed on the latent image carrier.

Moreover, as described above, an image forming apparatus of the present invention performing image formation by (1) forming the electrostatic latent images on the latent image carriers, (2) visualizing the electrostatic latent images so as to form images in different colors, (3) transferring, one by one onto the intermediate transfer member, the images thus formed in different colors, so as to form an image as a result of the transfer of the respective images thus formed in different colors and (4) transferring the image from the intermediate transfer member onto a recording medium, is arranged such that the intermediate transfer member has a latent image holding property for holding an electrostatic latent image; and an image formed on the intermediate transfer member by visualizing an electrostatic latent image formed on the intermediate transfer member is superimposed with the images formed by visualizing the electrostatic latent images respectively formed on the latent image carriers.

Furthermore, as described above, a method of the present invention for forming an image by using an image forming apparatus including a latent image carrier for holding an electrostatic latent image, and an intermediate transfer member having a latent image holding property for holding an electrostatic latent image, includes forming the electrostatic latent image on the intermediate transfer member and visualizing the electrostatic latent image so as to form an image on the intermediate transfer member; forming the electrostatic latent image on the latent image carrier and visualizing the electrostatic latent image so as to form an image on the latent image carrier; performing primary transfer for transferring, onto the intermediate transfer member, the image formed on the latent image carrier, so as to form a primary transfer image, and superimposing, onto the primary transfer image, the image formed on the intermediate transfer member, so as to form a superimposed image on the intermediate transfer member; and performing secondary transfer for transferring the superimposed image on a recording medium, so as to form an image.

With these arrangements, the intermediate transfer member can function as a latent image carrier because the intermediate transfer member has the latent image holding property for holding the electrostatic latent image. Because of this, these arrangements allows reduction of a number of the latent image carriers. Moreover, with these arrangements, a number of transfer (a number of transfer processes) from the latent image carrier to the intermediate transfer member can be reduced. Thus, it is possible to reduce numbers of necessary components such as cleaning sections, transferring sections and other components which are necessary as many as the number of transfer, that is, as many as the latent image carrier. As a result, the image forming apparatus can be downsized accordingly.

Because the intermediate transfer member includes a conductive base member and a photosensitive layer formed on the conductive base member, the intermediate transfer member has an optical conductivity (latent image holding property) that allows the intermediate transfer member to serve as a latent image carrier.

It is preferable that the intermediate transfer member be a belt member that is rotatably tensioned by using at least two supporting members.

With the arrangement in which the intermediate transfer member is a belt member that is rotatably tensioned by using at least two supporting members, it becomes possible not only to give a greater degree of freedom in interior layout of the image formation section 210 to make it easier to design, but also to further downsize the image forming apparatus. Moreover, common units and parts can be used effectively, thereby reducing manufacturing cost and cost of maintenance parts.

It is preferable that that portion of the intermediate transfer member which be supported by one of the supporting members performs the formation and visualization of the electrostatic latent image.

With the arrangement in which that portion of the intermediate transfer member which is supported by one of the supporting members performs the formation and visualization of the electrostatic latent image, that position on the intermediate at which the image is visualized is stabilized. This attains good visualization.

Moreover, by arranging the supporting member to be conductive, it becomes possible to cause the supporting member to act as a base member of the latent image carrier. This allows the intermediate transfer member to utilize its optical conductive property, thereby attaining good visualization.

Further, it is preferable that the one of the supporting members have an outer diameter that allows the intermediate transfer member to have a pitch circle having a curvature equal to a curvature of a surface of the latent image carrier.

With the arrangement in which the one of the supporting members has an outer diameter that allows the intermediate transfer member to have a pitch circle having a curvature equal to a curvature of a surface of the latent image carrier, common main components necessary for the image formation can be shared between the latent image carrier and the intermediate transfer member.

Furthermore, it is preferable that at least that portion of the one of the supporting members (specifically, e.g. the supporting member that supports that portion of the intermediate transfer member in which the formation and visualization of the electrostatic latent image is performed) which is contactable with the intermediate transfer member be conductive, and be grounded or have a potential of a polarity opposite to a polarity in which the latent image carrier is electrified.

With the arrangement in which at least that portion of the one of the supporting members which is contactable with the intermediate transfer member is conductive, and is grounded or has a potential of a polarity opposite to a polarity in which the latent image carrier is electrified, it is possible to accelerate the attenuation of the surface potential that is obtained due to the electrification property of the intermediate transfer member and the formation of the latent image. This results in good image formation.

Further, it is preferable that the intermediate transfer member be a belt member that is rotatably tensioned by using at least two supporting members, and that portion of the intermediate transfer member which is supported by one of the supporting members perform the formation and visualization of the electrostatic latent image; and (A) a distance between (a) an electrostatic latent image formation position on the intermediate transfer member and (b) a transfer nip formed by abutment of the intermediate transfer member and the latent image carrier, and (B) a length of circumference of the latent image carrier be equal; and that one of the supporting members which supports that portion of the intermediate transfer member which performs the formation and visualization of the electrostatic latent image have an outer diameter that allows the intermediate transfer member to have a pitch circle having a curvature equal to a curvature of a surface of the latent image carrier.

With the arrangement in which the intermediate transfer member is a belt member that is rotatably tensioned by using at least two supporting members, and that portion of the intermediate transfer member which is supported by one of the supporting members performs the formation and visualization of the electrostatic latent image; (A) a distance between (a) an electrostatic latent image formation position on the intermediate transfer member and (b) a transfer nip formed by abutment of the intermediate transfer member and the latent image carrier, and (B) a length of circumference of the latent image carrier are equal; and that one of the supporting members which supports that portion of the intermediate transfer member which performs the formation and visualization of the electrostatic latent image has an outer diameter that allows the intermediate transfer member to have a pitch circle having a curvature equal to a curvature of a surface of the latent image carrier, it is possible to synchronize the phase of the rotation unevenness (speed error value) of the latent image carrier and the phase of the rotation movement unevenness of the intermediate transfer member. This can cause color misregistration less conspicuous.

In the case where the image forming apparatus performs image formation by (1) forming the electrostatic latent images on the latent image carriers, (2) visualizing the electrostatic latent images so as to form images in different colors, (3) transferring the images one by one onto the intermediate transfer member, it is preferable that the intermediate transfer member be a belt member that is rotatably tensioned by using at least two supporting members, and that portion of the intermediate transfer member which is supported by one of the supporting members performs the formation and visualization of the electrostatic latent image; (A) intervals between transfer nips formed by abutment of the intermediate transfer member and the latent image carriers, (B) a distance between (a) an electrostatic latent image formation position on the intermediate transfer member and (b) that one of the transfer nip which is nearest from the intermediate transfer member, and (C) a length of circumference of the latent image carrier be equal; and that one of the supporting members which supports that portion of the intermediate transfer member which performs the formation and visualization of the electrostatic latent image have an outer diameter that allows the intermediate transfer member to have a pitch circle having a curvature equal to a curvature of surfaces of the latent image carriers.

With the arrangement in which the intermediate transfer member is a belt member that is rotatably tensioned by using at least two supporting members, and that portion of the intermediate transfer member which is supported by one of the supporting members performs the formation and visualization of the electrostatic latent image; (A) intervals between transfer nips formed by abutment of the intermediate transfer member and the latent image carriers, (B) a distance between (a) an electrostatic latent image formation position on the intermediate transfer member and (b) that one of the transfer nip which is nearest from the intermediate transfer member, and (C) a length of circumference of the latent image carriers are equal; and that one of the supporting members which supports that portion of the intermediate transfer member which performs the formation and visualization of the electrostatic latent image has an outer diameter that allows the intermediate transfer member to have a pitch circle having a curvature equal to a curvature of surfaces of the latent image carriers, it is possible to synchronize the phase of the rotation unevenness of the latent image carrier and the phase of the rotation movement unevenness of the intermediate transfer member. This can cause color misregistration less conspicuous.

As described above, the image forming device of the present invention is an image forming apparatus of intermediate transfer type in which an image formed by visualizing an electrostatic latent image formed on a latent image carrier is temporally transferred to an intermediate transfer member and then transferred from the intermediate transfer member onto a recording medium. Because the intermediate transfer member has the electrostatic latent image holding property and thus can serve as the intermediate transfer member and a latent image carrier, the arrangement of the present invention can reduce the number of the latent image carriers. Furthermore, a number of transfer (a number of transfer processes) from the latent image carrier to the intermediate transfer member can be reduced. Thus, it is possible to reduce numbers of necessary components such as cleaning sections, transferring sections and other components which are necessary as many as the number of transfer, that is, as many as the latent image carrier. As a result, the image forming apparatus can be downsized accordingly. Moreover, because the image forming apparatus of the present invention is of the intermediate transfer type, the image forming apparatus of the present invention is applicable for various recording media. Because of this, the image forming apparatus of the present invention is suitably applicable to various image forming apparatus such as printers, fax machines, copying machines and the like.

The present invention, which is not limited by above described embodiments, may be variously modified within the scope of the following claims. Embodiments that can be attained by appropriate combination of technical means disclosed in different embodiments described above are also included within the technical scope of the present invention.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising (i) a latent image carrier for holding an electrostatic latent image, and (ii) an intermediate transfer member for temporally holding an image formed by visualizing the electrostatic latent image formed on the latent image carrier, the image forming apparatus performing image formation by (1) transferring, to the intermediate transfer member, the image formed by visualizing the latent image formed on the latent image carrier, so as to superimpose the image on an image held on the intermediate transfer member in order to prepare an superimposition image on the intermediate transfer member, and then (2) transferring the superimposition image onto a recording medium, wherein:

the intermediate transfer member has a latent image holding property for holding an electrostatic latent image; and an image formed on the intermediate transfer member by visualizing an electrostatic latent image formed on the intermediate transfer member is superimposed with the image formed by visualizing the electrostatic latent image formed on the latent image carrier;

the intermediate transfer member having a support member, the electrostatic latent image being formed at a contact area of the intermediate transfer member and the support member which supports the intermediate transfer member.

2. An image forming apparatus as set forth in claim 1, wherein:

the intermediate transfer member includes a conductive base member and a photosensitive layer formed on the conductive base member.

3. An image forming apparatus as set forth in claim 1, wherein:

the intermediate transfer member is a belt member that is rotatably tensioned by using at least two supporting members.

4. An image forming apparatus as set forth in claim 1, wherein:

the intermediate transfer member is a belt member that is rotatably tensioned by using at least two supporting members, and that portion of the intermediate transfer member which is supported by one of the supporting members performs the formation and visualization of the electrostatic latent image;

(A) a distance between (a) an electrostatic latent image formation position on the intermediate transfer member and (b) a transfer nip formed by abutment of the intermediate transfer member and the latent image carrier, and (B) a length of circumference of the latent image carrier are equal; and that one of the supporting members which supports that portion of the intermediate transfer member which performs the formation and visualization of the electrostatic latent image has an outer diameter that allows the intermediate transfer member to have a pitch circle having a curvature equal to a curvature of a surface of the latent image carrier.

5. An image forming apparatus comprising (i) a latent image carrier for holding an electrostatic latent image, and (ii) an intermediate transfer member for temporally holding an image formed by visualizing the electrostatic latent image formed on the latent image carrier, the image forming apparatus performing image formation by (1) transferring, to the intermediate transfer member, the image formed by visualizing the latent image formed on the latent image carrier, so as to superimpose the image on an image held on the intermediate transfer member in order to prepare an superimposition image on the intermediate transfer member, and then (2) transferring the superimposition image onto a recording medium, wherein:

the intermediate transfer member has a latent image holding property for holding an electrostatic latent image; and an image formed on the intermediate transfer member by visualizing an electrostatic latent image formed on the intermediate transfer member is superimposed with the image formed by visualizing the electrostatic latent image formed on the latent image carrier, wherein:

the intermediate transfer member is a belt member that is rotatably tensioned by using at least two supporting members, and that portion of the intermediate transfer member which is supported by one of the supporting members performs the formation and visualization of the electrostatic latent image.

6. An image forming apparatus as set forth in claim 5, wherein:

the one of the supporting members has an outer diameter that allows the intermediate transfer member to have a pitch circle having a curvature equal to a curvature of a surface of the latent image carrier.

7. An image forming apparatus as set forth in claim 5, wherein:

at least that portion of the one of the supporting members which is contactable with the intermediate transfer member is conductive, and is grounded or has a potential of a polarity opposite to a polarity in which the latent image carrier is electrified.

8. An image forming apparatus comprising (i) a plurality of latent image carriers for holding electrostatic latent images respectively, and (ii) an intermediate transfer member for temporally holding the latent images formed on the latent image carriers, the image forming apparatus performing image formation by (1) forming the electrostatic latent images on the latent image carriers, (2) visualizing the electrostatic latent images so as to form images in different colors, (3) transferring, one by one onto the intermediate transfer member, the images thus formed in different colors, so as to form an image as a result of the transfer of the respective images thus formed in different colors and (4) transferring the image from the intermediate transfer member onto a recording medium, wherein:

the intermediate transfer member has a latent image holding property for holding an electrostatic latent image; and an image formed on the intermediate transfer member by visualizing an electrostatic latent image formed on the intermediate transfer member is superimposed with the images formed by visualizing the electrostatic latent images respectively formed on the latent image carriers.

the intermediate transfer member having a support member, the electrostatic latent image being formed at a contact area of the intermediate transfer member and the support member which supports the intermediate transfer member.

9. An image forming apparatus as set forth in claim 8, wherein:

the intermediate transfer member includes a conductive base member and a photosensitive layer formed on the conductive base member.

10. An image forming apparatus as set forth in claim 8, wherein:

the intermediate transfer member is a belt member that is rotatably tensioned by using at least two supporting members.

11. An image forming apparatus as set forth in claim 8, wherein:

the intermediate transfer member is a belt member that is rotatably tensioned by using at least two supporting members, and that portion of the intermediate transfer member which is supported by one of the supporting members performs the formation and visualization of the electrostatic latent image;

(A) intervals between transfer nips formed by abutment of the intermediate transfer member and the latent image carriers, (B) a distance between (a) an electrostatic latent image formation position on the intermediate transfer member and (b) that one of the transfer nip which is nearest from the intermediate transfer member and (C) a length of circumference of the latent image carriers are equal; and that one of the supporting members which supports that portion of the intermediate transfer member which performs the formation and visualization of the electrostatic latent image has an outer diameter that allows the intermediate transfer member to have a pitch circle having a curvature equal to a curvature of surfaces of the latent image carriers.

12. An image forming apparatus as set forth in claim 8, wherein:

the latent image carriers are photosensitive drums, each of which is for holding the electrostatic latent image on a surface thereof by exposure; and around the intermediate transfer member, a visualizing member and the photosensitive drums are provided along the intermediate transfer member, the visualizing member being for visualizing the electrostatic latent image formed on a surface of the intermediate transfer member.

13. An image forming apparatus comprising (i) a plurality of latent image carriers for holding electrostatic latent images respectively, and (ii) an intermediate transfer member for temporally holding the latent images formed on the latent image carriers, the image forming apparatus performing image formation by (1) forming the electrostatic latent images on the latent image carriers, (2) visualizing the electrostatic latent images so as to form images in different colors, (3) transferring, one by one onto the intermediate transfer member, the images thus formed in different colors, so as to form an image as a result of the transfer of the respective images thus formed in different colors and (4) transferring the image from the intermediate transfer member onto a recording medium, wherein:

the intermediate transfer member has a latent image holding property for holding an electrostatic latent image; and an image formed on the intermediate transfer member by visualizing an electrostatic latent image formed on the intermediate transfer member is superimposed with the images formed by visualizing the electrostatic latent images respectively formed on the latent image carriers, wherein:

the intermediate transfer member includes a conductive base member and a photosensitive layer formed on the conductive base member, the intermediate transfer member is a belt member that is rotatably tensioned by using at least two supporting members, and that portion of the intermediate transfer member which is supported by one of the supporting members performs the formation and visualization of the electrostatic latent image.

14. An image forming apparatus as set forth in claim 13, wherein:

the one of the supporting members has an outer diameter that allows the intermediate transfer member to have a pitch circle having a curvature equal to a curvature of a surface of the latent image carrier.

15. An image forming apparatus as set forth in claim 13, wherein:

at least that portion of the one of the supporting members which is contactable with the intermediate transfer member is conductive, and is grounded or has a potential of a polarity opposite to a polarity in which the latent image carrier is electrified.

16. A method of forming an image by using an image forming apparatus including a latent image carrier for holding an electrostatic latent image, and an intermediate transfer member having a latent image holding property for holding an electrostatic latent image, the method comprising:

forming the electrostatic latent image on the intermediate transfer member and visualizing the electrostatic latent image so as to form an image on the intermediate transfer member, the intermediate transfer member having a support member, the electrostatic latent image being formed at a contact area of the intermediate transfer member and the support member which supports the intermediate transfer member;

forming the electrostatic latent image on the latent image carrier and visualizing the electrostatic latent image so as to form an image on the latent image carrier;

performing primary transfer for transferring, onto the intermediate transfer member, the image formed on the latent image carrier, so as to form a primary transfer image, and superimposing, onto the primary transfer image, the image formed on the intermediate transfer member, so as to form a superimposed image on the intermediate transfer member; and performing secondary transfer for transferring the superimposed image on a recording medium, so as to form an image.

17. An image forming apparatus comprising (i) a latent image carrier for holding an electrostatic latent image, and (ii) an intermediate transfer member for temporally holding an image formed by visualizing the electrostatic latent image formed on the latent image carrier, the image forming apparatus performing image formation by (1) transferring, to the intermediate transfer member, the image formed by visualizing the latent image formed on the latent image carrier, so as to superimpose the image on an image held on the intermediate transfer member in order to prepare an superimposition image on the intermediate transfer member, and then (2) transferring the superimposition image onto a recording medium, wherein:

the intermediate transfer member has a latent image holding property for holding an electrostatic latent image; and an image formed on the intermediate transfer member by visualizing an electrostatic latent image formed on the intermediate transfer member is superimposed with the image formed by visualizing the electrostatic latent image formed on the latent image carrier, the intermediate transfer member having a support member, the electrostatic latent image being visualized at a contact area of the intermediate transfer member and the support member which supports the intermediate transfer member.

18. A method of forming an image by using an image forming apparatus including a latent image carrier for holding an electrostatic latent image, and an intermediate transfer member having a latent image holding property for holding an electrostatic latent image, the method comprising:

forming the electrostatic latent image on the intermediate transfer member and visualizing the electrostatic latent image so as to form an image on the intermediate transfer member, the intermediate transfer member having a support member, the electrostatic latent image being visualized at a contact area of the intermediate transfer member and the support member which supports the intermediate transfer member;

forming the electrostatic latent image on the latent image carrier and visualizing the electrostatic latent image so as to form an image on the latent image carrier;

performing primary transfer for transferring, onto the intermediate transfer member, the image formed on the latent image carrier, so as to form a primary transfer image, and superimposing, onto the primary transfer image, the image formed on the intermediate transfer member, so as to form a superimposed image on the intermediate transfer member; and performing secondary transfer for transferring the superimposed image on a recording medium, so as to form an image.

* * * * *